US007958838B1

(12) United States Patent
Larose et al.

(10) Patent No.: US 7,958,838 B1
(45) Date of Patent: Jun. 14, 2011

(54) WATERCRAFT HULL

(75) Inventors: Benoit Larose, Mont-Saint-Hilaire (CA); Michel Bourret, Drummondville (CA)

(73) Assignee: Bombardier Recreational Products Inc., Valcourt (CA)

( * ) Notice: Subject to any disclaimer, the term of this patent is extended or adjusted under 35 U.S.C. 154(b) by 720 days.

(21) Appl. No.: 11/962,977

(22) Filed: Dec. 21, 2007

(51) Int. Cl.
*B63B 5/00* (2006.01)
*B63B 5/24* (2006.01)

(52) U.S. Cl. ..... 114/355; 114/357

(58) Field of Classification Search ..... 114/65 R, 114/355–359, 55.5–55.58
See application file for complete search history.

(56) References Cited

U.S. PATENT DOCUMENTS

| | | | | | |
|---|---|---|---|---|---|
| 2,400,771 | A | * | 5/1946 | Moxham, Jr. | 114/65 R |
| 2,422,183 | A | * | 6/1947 | Clement, Jr. | 114/358 |
| 2,683,269 | A | * | 7/1954 | Harkins | 114/125 |
| 2,956,292 | A | * | 10/1960 | Newsome | 114/357 |
| 3,593,354 | A | | 7/1971 | Carter | |
| 3,736,608 | A | * | 6/1973 | Whitehead | 114/356 |
| 3,848,284 | A | | 11/1974 | Linvingston | |
| 4,041,561 | A | | 8/1977 | Humphrey | |
| 4,044,414 | A | | 8/1977 | Grycel | |
| 4,214,332 | A | | 7/1980 | Stoner | |
| 4,405,669 | A | * | 9/1983 | Pott | 428/61 |
| 4,917,037 | A | | 4/1990 | Hargett | |
| 5,036,789 | A | * | 8/1991 | Kelly et al. | 114/357 |
| 5,758,594 | A | | 6/1998 | Siewert | |
| 5,787,836 | A | | 8/1998 | Blaisdell et al. | |
| 5,799,604 | A | * | 9/1998 | Long | 114/359 |
| 6,161,496 | A | | 12/2000 | Fulks | |
| 6,182,591 | B1 | | 2/2001 | Whitesides et al. | |
| 6,471,557 | B1 | | 10/2002 | Hattori | |
| 2004/0261937 | A1 | * | 12/2004 | Pellicer | 156/242 |
| 2005/0056200 | A1 | * | 3/2005 | Pigeon | 114/357 |

FOREIGN PATENT DOCUMENTS

JP 06199274 A * 7/1994

* cited by examiner

*Primary Examiner* — Ajay Vasudeva
(74) *Attorney, Agent, or Firm* — Olser, Hoskin & Harcourt LLP

(57) ABSTRACT

A watercraft hull has a hull body defining a bow, a transom, and a longitudinal centerline extending from the bow to the transom along a center of the hull body. The hull body has an inner surface and an outer surface. A plurality of ribs extends at an angle to the longitudinal centerline on the inner surface.

19 Claims, 12 Drawing Sheets

WATERCRAFT HULL

FIELD OF THE INVENTION

The present invention relates to hulls for watercraft.

BACKGROUND OF THE INVENTION

Many watercraft hulls are made of composites. The most common composite used is glass fibers mixed with unsaturated polyester. These hulls are typically made using an open mold process. In this process, the mold is first coated with a gel coat, then a mixture of glass fibers and resin is laid inside the mold, and the mixture is then rolled manually to expel the air and ensure that it conforms to the mold. In order to increase the rigidity of the hull, foam pieces are disposed in certain areas of the hull and are then coated (often manually) with the mixture of glass fibers and resin, which needs to be manually rolled. The glass fiber coated mold is then cured and the finished hull subsequently removed from the mold.

Alternatively, the glass fiber coated mold is cured prior to placing the foam pieces. The foam pieces are separately coated with the mixture of cut glass fibers and resin and, once cured, are glued inside the hull.

Both of these methods result in a hull having a double-wall construction in some areas. Although this provides a hull with the necessary rigidity for most applications, it may be desirable to provide a hull with more rigidity for some more demanding applications. Also, the foam pieces used in the above hulls take up a substantial amount of space within the hull, and the resulting hull is also relatively heavy. The manufacturing process is also substantially labor intensive which increases the cost of the hull.

Therefore, there is a need for a watercraft hull which ameliorates at least some of the inconveniences mentioned above.

SUMMARY OF THE INVENTION

It is an object of the present invention to provide a watercraft hull having ribs extending at an angle to a longitudinal centerline thereof.

In one aspect, the invention provides a watercraft hull having a hull body defining a bow, a transom, and a longitudinal centerline extending from the bow to the transom along a center of the hull body. The hull body has an inner surface and an outer surface. At least one port rib extends at an angle to the longitudinal centerline on the inner surface. The at least one port rib has a first portion disposed on a port side of the longitudinal centerline and a second portion disposed on a starboard side of the longitudinal centerline. The first portion is longer than the second portion. At least one starboard rib extends at an angle to the longitudinal centerline on the inner surface. The at least one starboard rib has a first portion disposed on the starboard side of the longitudinal centerline and a second portion disposed on the port side of the longitudinal centerline. The first portion is longer than the second portion. One of the at least one port rib and the at least one starboard rib is disposed at least in part forwardly of the other of the at least one port rib and the at least one starboard rib.

In a further aspect, the at least one port rib is a plurality of port ribs and the at least one starboard rib is a plurality of starboard ribs. The plurality of port ribs and the plurality of starboard ribs are disposed in an alternating arrangement along a length of the hull body.

In an additional aspect, a secondary rib extends at an angle to the longitudinal centerline on the inner surface. The secondary rib is disposed completely on one side of the longitudinal centerline.

In a further aspect, the plurality of port ribs and the plurality of starboard ribs extend generally perpendicularly to the longitudinal centerline.

In an additional aspect, at least one of the plurality of port ribs and the plurality of starboard ribs has an enlarged portion adapted to receive a fastener.

In a further aspect, a threaded insert is disposed in the enlarged portion.

In an additional aspect, the hull body defines a port side wall and a starboard side wall. At least part of the first portion of the at least one port rib extends along the port side wall. At least part of the first portion of the at least one starboard rib extends along the starboard side wall.

In a further aspect, the hull body, the at least one port rib, and the at least one starboard rib are integrally formed.

In an additional aspect, the hull body, the at least one port rib, and the at least one starboard rib are made of a mixture of cut glass fibers and urethane resin.

In a further aspect, a height of at least one port rib is greater than a width of the at least one port rib, and a height of at least one starboard rib is greater than a width of the at least one starboard rib.

In an additional aspect, a width of the at least one port rib is at least 1.5 times a thickness of the hull body at a position adjacent the at least one port rib, and a width of the at least one starboard rib is at least 1.5 times a thickness of the hull body at a position adjacent the at least one starboard rib.

In another aspect, the invention provides a watercraft hull having a hull body defining a bow, a transom, and a longitudinal centerline extending from the bow to the transom along a center of the hull body. The hull body has an inner surface and an outer surface. At least one first rib extends at an angle to the longitudinal centerline on the inner surface. The at least one first rib is disposed completely on one of a port side and a starboard side of the longitudinal centerline. At least one second rib extends at an angle to the longitudinal centerline on the inner surface. The at least one second rib is disposed at least in part on the other of the port side and the starboard side of the longitudinal centerline.

In a further aspect, the at least one second rib is disposed completely on the other of the port side and the starboard side of the longitudinal centerline.

In an additional aspect, the at least one first rib is disposed in longitudinal alignment with the at least one second rib, and the at least one first rib is laterally spaced from the at least one second rib.

In a further aspect, the at least one first rib is a plurality of first ribs and the at least one second rib is a plurality of second ribs.

In an additional aspect, at least one of the plurality of first ribs and the plurality of second ribs has an enlarged portion adapted to receive a fastener.

In a further aspect, a threaded insert is disposed in the enlarged portion.

In an additional aspect, a height of at least one first rib is greater than a width of the at least one first rib, and a height of at least one second rib is greater than a width of the at least one second rib.

In a further aspect, a width of the at least one first rib is at least 1.5 times a thickness of the hull body at a position adjacent the at least one first rib, and a width of the at least one second rib is at least 1.5 times a thickness of the hull body at a position adjacent the at least one second rib.

In an additional aspect, the at least one first rib and the at least one second rib extend generally perpendicularly to the longitudinal centerline.

For purposes of this application, terms related to spatial orientation such as forwardly, rearwardly, left, and right, are as they would normally be understood by a driver of the watercraft sitting thereon in a normal driving position. The terms "port" and "starboard" refer respectively to the left and right sides of the watercraft when looking forward while on the watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft and a hull thereof. However, it should be understood that other types of watercraft and hulls are contemplated, such as hulls for jet boats.

The general construction of a personal watercraft 10 will now be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass these other known ways and designs.

Figure 1:
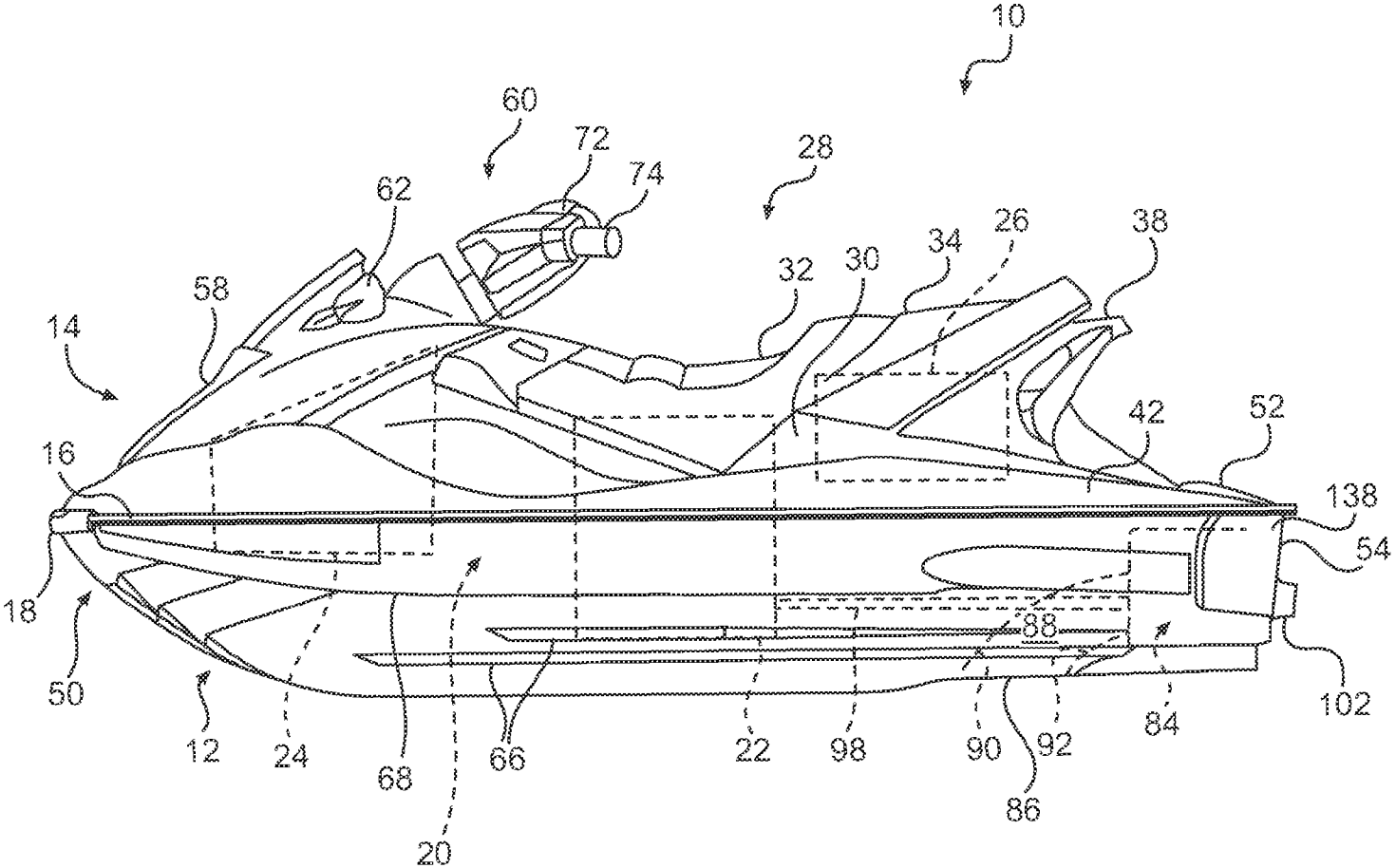
FIG. 1 illustrates a side view of a personal watercraft.

The watercraft 10 of FIG. 1 is made of a hull 12 and a deck 14. The hull 12 buoyantly supports the watercraft 10 in the water. The deck 14 is designed to accommodate a rider and one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion of or the entire seam 16.

The space between the hull 12 and the deck 14 forms a volume commonly referred to as the engine compartment 20 (shown in phantom). The engine compartment 20 accommodates an engine 22, as well as an exhaust system, fuel system, electrical system (battery, electronic control unit, etc.), air intake system, storage bins 24, 26, and other elements required or desirable in the watercraft 10.

Figure 2:
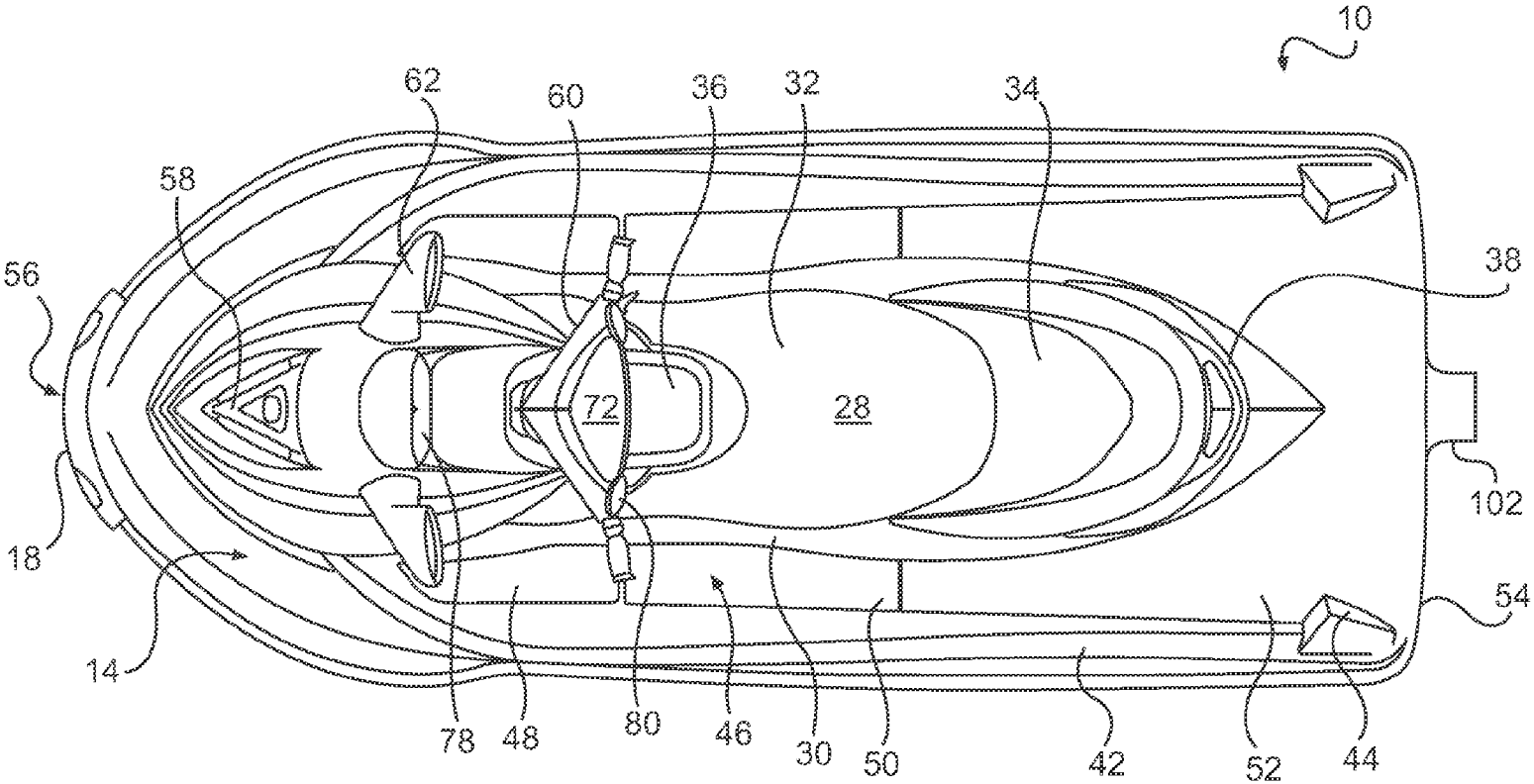
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate a driver and at least one passenger. As seen in FIG. 2, the seat 28 includes a first, front seat portion 32 for the driver and a rear, raised seat portion 34 for the at least one passenger. The seat 28 is preferably made as a cushioned or padded unit or interfitting units. The first and second seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) can cover a removable storage box 26 (FIG. 1). A "glove compartment" or small storage box 36 is provided in front of the seat 28.

Figure 4:
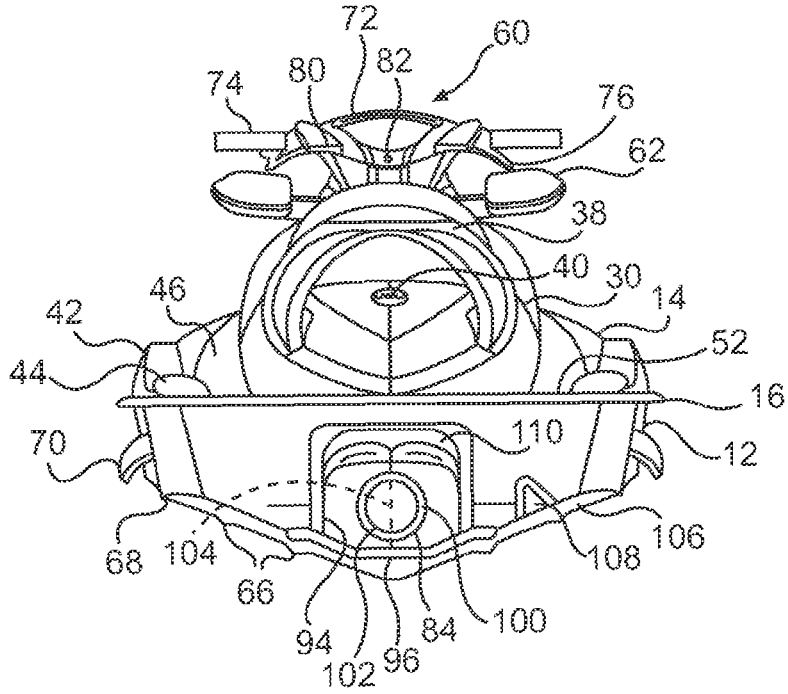
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. A passenger riding the watercraft 10 facing towards the rear, to spot a water-skier for example, may place his or her heels on the heel rests 44, thereby providing a more stable riding position. Heel rests 44 could also be formed separately from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
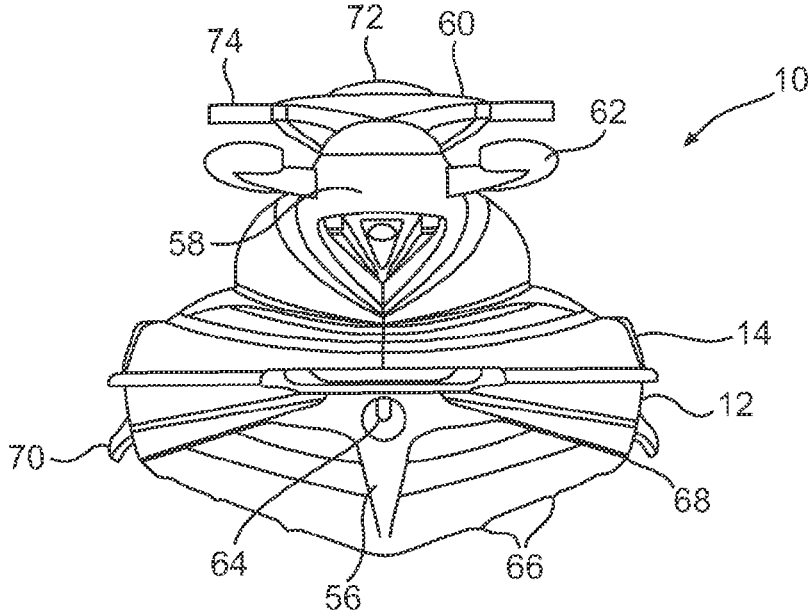
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft on a trailer, for instance.

Figure 5:
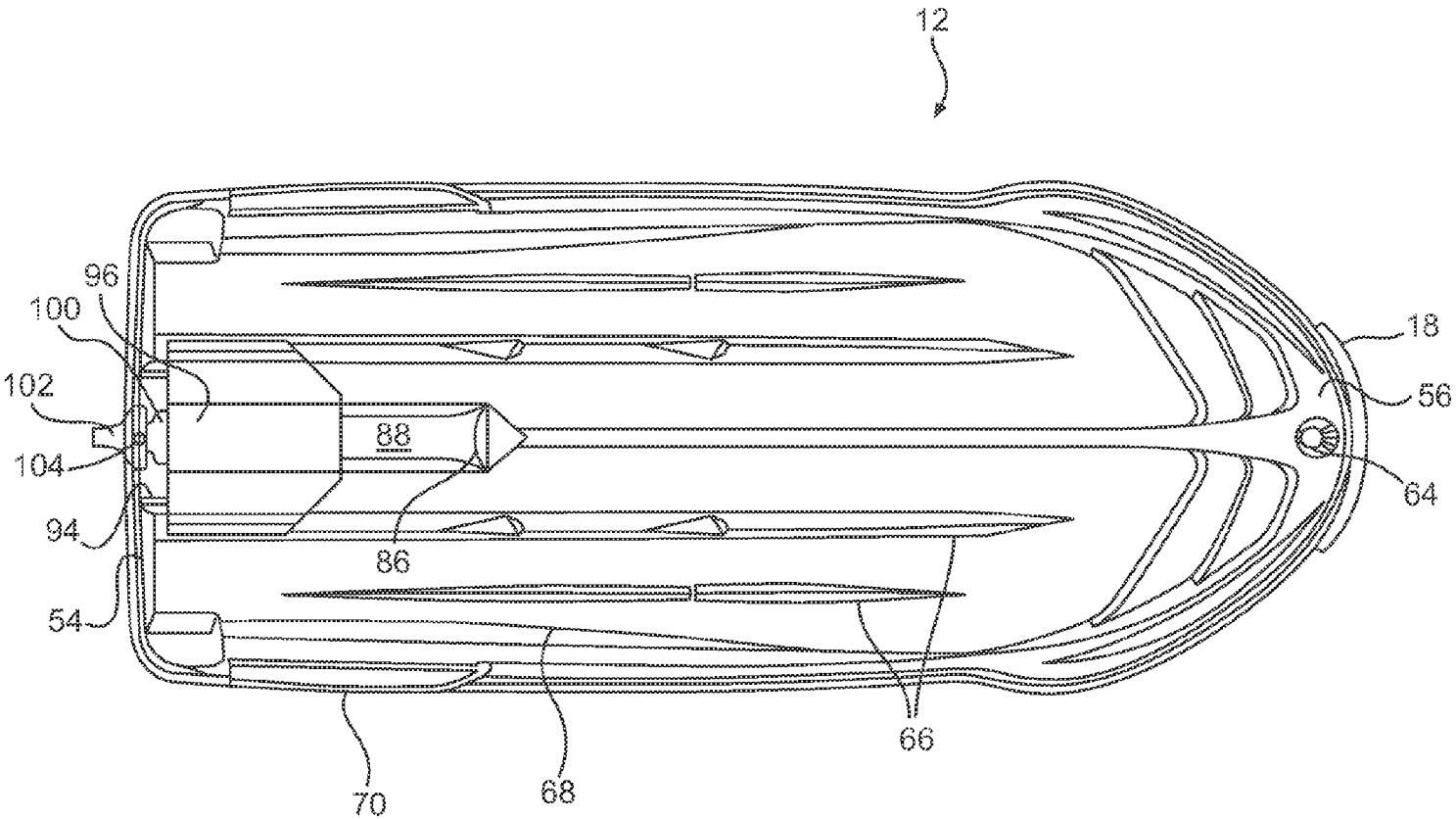
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics. The construction of the hull 12 will be described in greater detail below.

Sponsons 70 are located on both sides of the hull 12 near the transom 54. The sponsons 70 have an arcuate undersurface that gives the watercraft 10 both lift while in motion and improved turning characteristics. The sponsons are preferably fixed to the surface of the hull 12 and can be attached to the hull 12 by fasteners or molded therewith. Sometimes it may be desirable to adjust the position of the sponson 70 with respect to the hull 12 to change the handling characteristics of the watercraft 10 and accommodate different riding conditions. Trim tabs, which are commonly known, may also be provided at the transom and may be controlled from the helm 60.

As best seen in FIGS. 3 and 4, the helm assembly 60 is positioned forwardly of the seat 28. The helm assembly 60 has a central helm portion 72, which may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. In a preferred embodiment, the throttle operator 76 is biased towards the idle position, such that, should the driver of the watercraft let go of the throttle operator 76, it will move to the idle position.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 also has various buttons 80, which could alternatively be in the form of levers or switches, that allow the rider to modify the display data or mode (speed, engine rpm, time . . . ) on the display cluster 78 or to change a condition of the watercraft 10, such as trim (the pitch of the watercraft).

The helm assembly 60 is also provided with a key receiving post 82, located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is propelled by a jet propulsion system 84. As is known, the jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12, referred to as the tunnel 94. The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet propulsion system 84 includes a jet pump that includes two main parts: the impeller (not shown) and the stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet propulsion system 84, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Moreover, the steering nozzle 102 can be replaced by a rudder or other diverting mechanism disposed at the exit of the tunnel 94 to selectively direct the thrust generated by the jet propulsion system 84 to effect turning.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi 100, so as to redirect the thrust and steer the watercraft 10 in the desired direction. Optionally, the steering nozzle 102 may be gimbaled to allow it to move around a second horizontal pivot axis. The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 also turns faster. An electronic control unit (ECU) 200 (FIG. 12) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

The watercraft 10 is provided with a reverse gate 110 which is movable between a first stowed position where it does not interfere with the jet of water being expelled by the jet propulsion system 84 and a plurality of positions where it redirects the jet of water being expelled by the jet propulsion system 84. It is contemplated that the reverse gate 110 could be mounted directly on the jet propulsion system 84 so as to move with the steering nozzle 102 as it turns and trims. Details of this arrangement can be found in U.S. Pat. No. 6,533,623 B2, issued Mar. 18, 2003, the entirety of which is incorporated herein by reference. It is also contemplated that the reverse gate 110 could be pivotally attached to the sidewalls of the tunnel 94.

Figure 6:
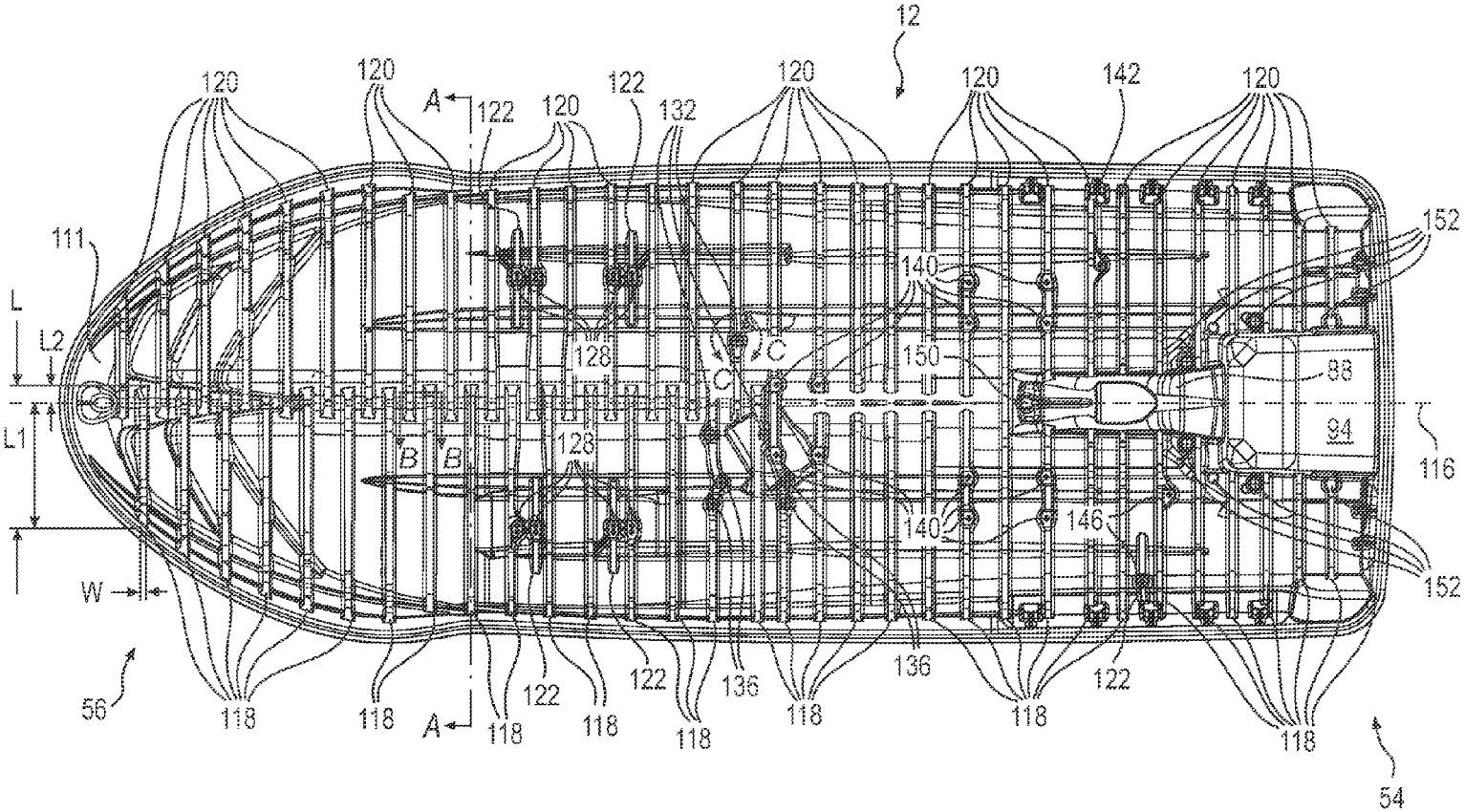
FIG. 6 is a top view of the hull of the watercraft of FIG. 1.
Figure 7:
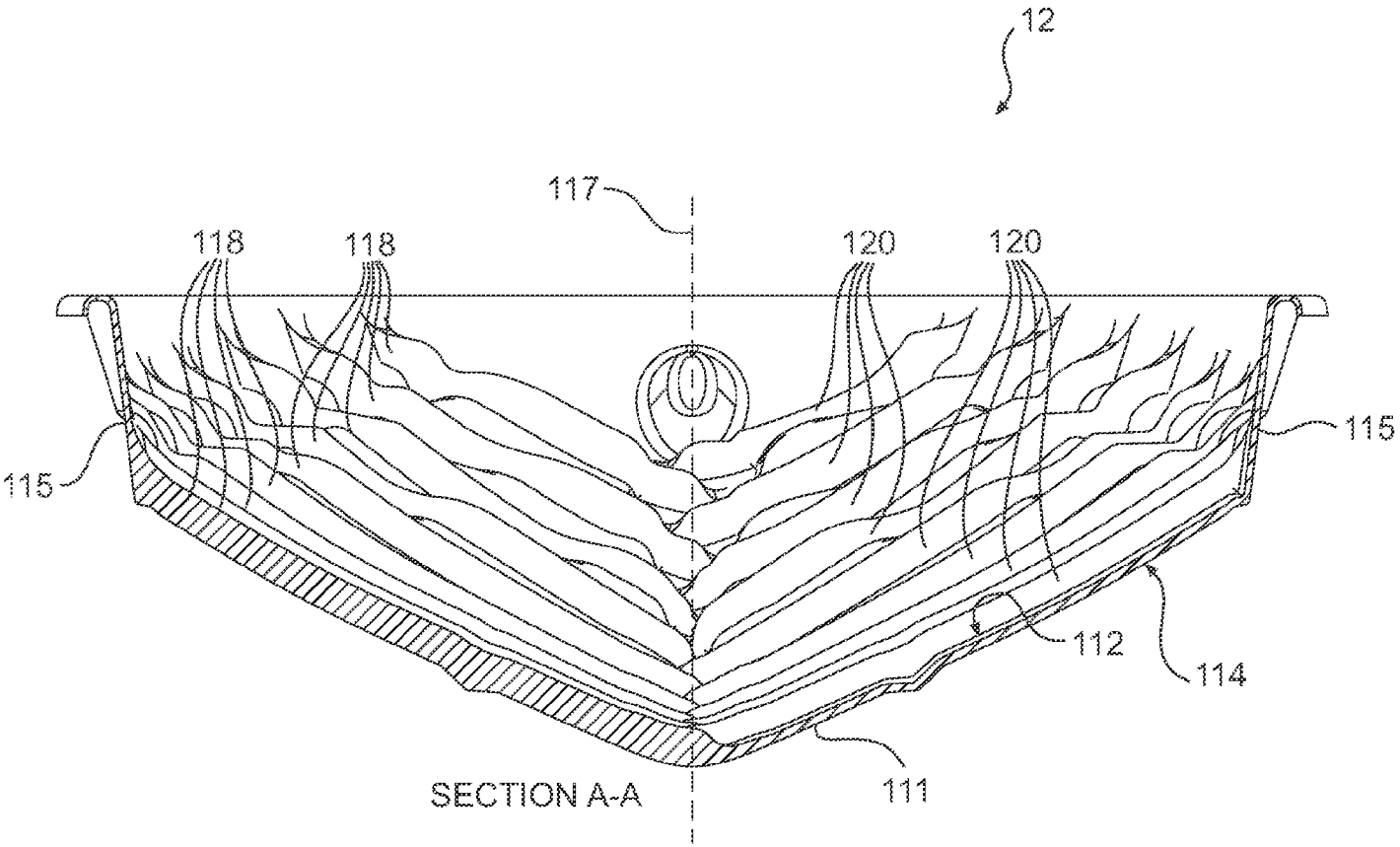
FIG. 7 is a cross-sectional view of the hull taken along line A-A in FIG. 6.

Turning now to FIGS. 6 to 13, the hull 12 will be described in greater detail. The hull 12 has a hull body 111 which defines the bow 56, transom 54, tunnel, intake ramp 88, and port and starboard sides 115 (FIG. 7). A longitudinal centerline 116 of the hull body 111 extends from the bow 56 to the transom 54 along a center of the hull body 111. In FIG. 7, a vertical plane 117 passing through the longitudinal centerline 116 is illustrated to indicate the location of the longitudinal centerline 116 in this figure. The hull body 111 has an inner surface 112 and an outer surface 114. The specific geometry and configuration of strakes 66 and chines 68 on the outer surface 114 will depend on the riding and handling characteristics to be provided to the watercraft 10. Therefore it should be understood that geometries and configurations of the outer surface 114 of the hull 12 other than the one shown here are contemplated.

Figure 12:
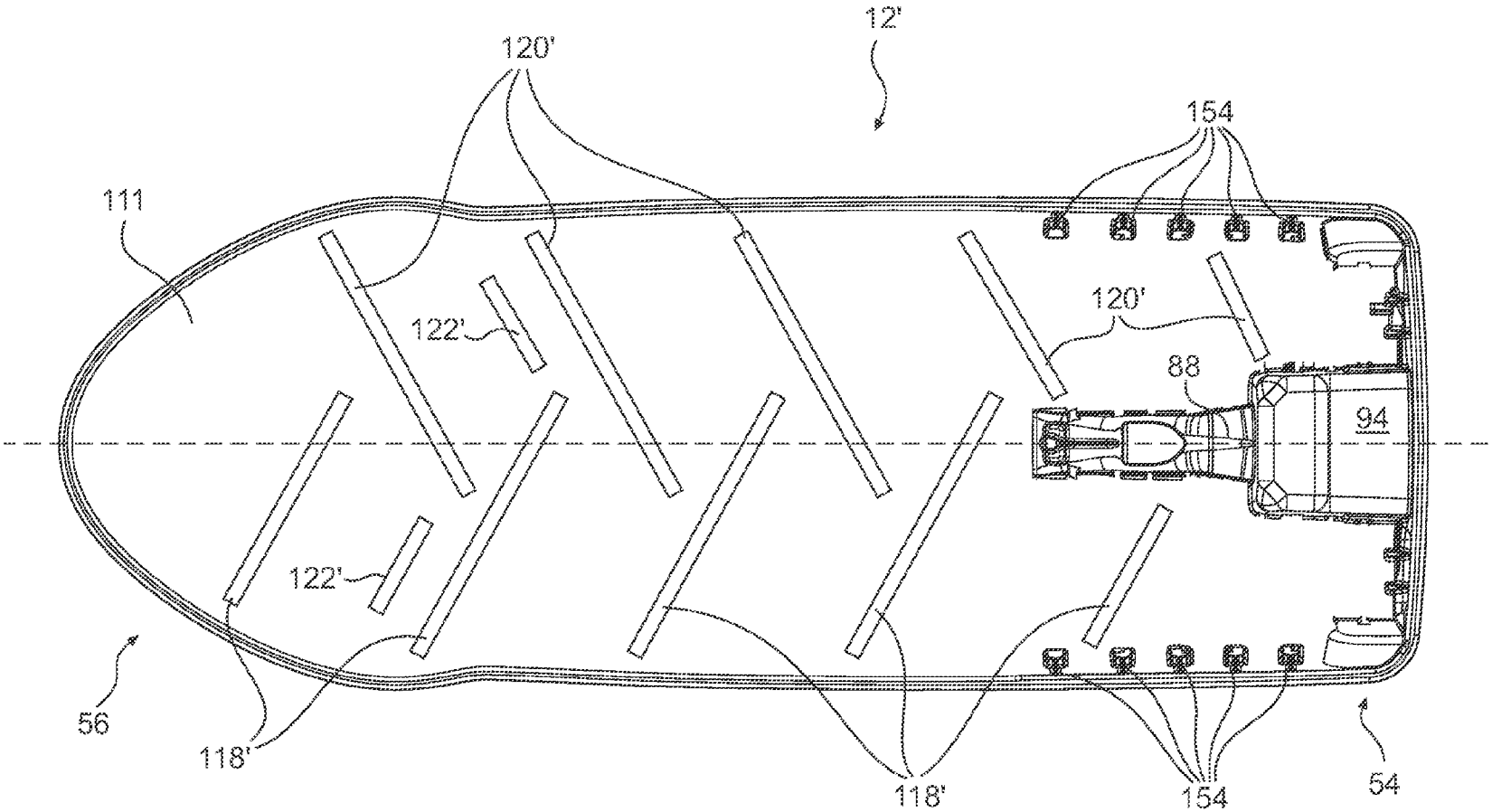
FIG. 12 is a top view of a second embodiment of the hull of the watercraft of FIG. 1 with the ribs shown schematically.

A plurality of port ribs 118 and starboard ribs 120 extend generally perpendicularly to the longitudinal centerline 116 on the inner surface 112 of the hull body 111 to increase the rigidity of the hull 12. As seen in FIG. 12, it is contemplated that a hull 12' could have a plurality of port ribs 118' and starboard ribs 120' extending at other angles with respect to the longitudinal centerline 116.

As seen in FIG. 6, the ribs 118, 120 located in the front portion of the hull 12 cross the longitudinal centerline 116. Although their overall lengths vary, each of these port ribs 118 has a first portion on the port side of the longitudinal centerline 116 and a second portion on the starboard side, where the first portion is longer than the second portion. Similarly, although their overall lengths vary, each of these starboard ribs 120 has a first portion on the starboard side of the longitudinal centerline 116 and a second portion on the port side, where the first portion is longer than the second portion. For example, as shown in FIG. 6, the forward most port rib 118 has a width W and a length L, where a first portion of the rib 118 disposed on the port side has length L1 and a second portion of the rib 118 disposed on the starboard side has a length L2. As can be seen L2 is shorter than L1. As such, these port and starboard ribs 118, 120 are disposed in an alternating arrangement along a length of the hull body 111. Also, as can be seen in FIG. 7, part of the first portion of the port and starboard ribs 118, 120 extend along their corresponding side walls 115.

The ribs 118, 120 located in the rear portion of the hull 12 are disposed completely on a corresponding side of the longitudinal centerline 116, and as such do not cross the longitudinal centerline 116. As such, these port and starboard ribs 118, 120 are disposed in longitudinal alignment (i.e. in line) with each other along a length of the hull body 111, and each pair of ribs 118, 120 (i.e. one port rib 118 and one starboard rib 120 aligned with each other) has a space therebetween. It is contemplated that these port and starboard ribs 118 could also be disposed in an alternating arrangement like the port and starboard ribs 118 at the front of the hull. The ribs 118, 120 disposed on either sides of the water intake ramp 88 and the tunnel 94 do not extend all the way to the sides of these components. A small space is left between sides of the intake ramp 88 and the tunnel 94 and the ends of the ribs 118, 120. It is contemplated however that the ribs 118, 120 disposed on either sides of the water intake ramp 88 and the tunnel 94 could extend all the way to the sides of these components It is contemplated that the hull 12 could only have ribs 118, 120 that cross the longitudinal centerline 116, like the ribs 118, 120 located in the front portion described above. It is also contemplated that the hull 12 could only have port and starboard ribs 118, 120 that are disposed completely on a corresponding side of the longitudinal centerline 116, like the ribs 118, 120 located in the rear portion described above. Other combination of the two types of port and starboard ribs 118, 120 are also contemplated.

During operation, some water will enter the hull 12 of the watercraft 10. By having port and starboard ribs 118, 120 that do not extend the full width of the hull 12 or that do not cross the longitudinal centerline 116, any water that enters the hull 12 will be able to drain towards the transom 54 when the watercraft 10 is being operated, where it can be pumped out of the hull 12 by bilge pumps (not shown).

A plurality of secondary ribs 122 extend generally perpendicularly to the longitudinal centerline 116 on the inner surface 112 of the hull body 111. As seen in FIG. 12, secondary ribs 122' could also extend at other angles with respect to the longitudinal centerline 116 in order to match the angles of port and starboard ribs 118', 120'. The secondary ribs 122 are disposed completely on one side of the longitudinal centerline 116. In addition to further increasing the rigidity of the hull 12, the secondary ribs 122 also provide additional points onto which to attach components of the watercraft 10, as described in greater detail below. In the front portion of the hull 12, the secondary ribs 122 are disposed in longitudinal alignment with port and starboard ribs 118, 122 in order to provide attachment points which are in line with each other. For example, a secondary rib 122 disposed on a port side of the longitudinal centerline 116 is disposed between two port ribs 118 and is in longitudinal alignment with a starboard rib 120.

Figure 9:
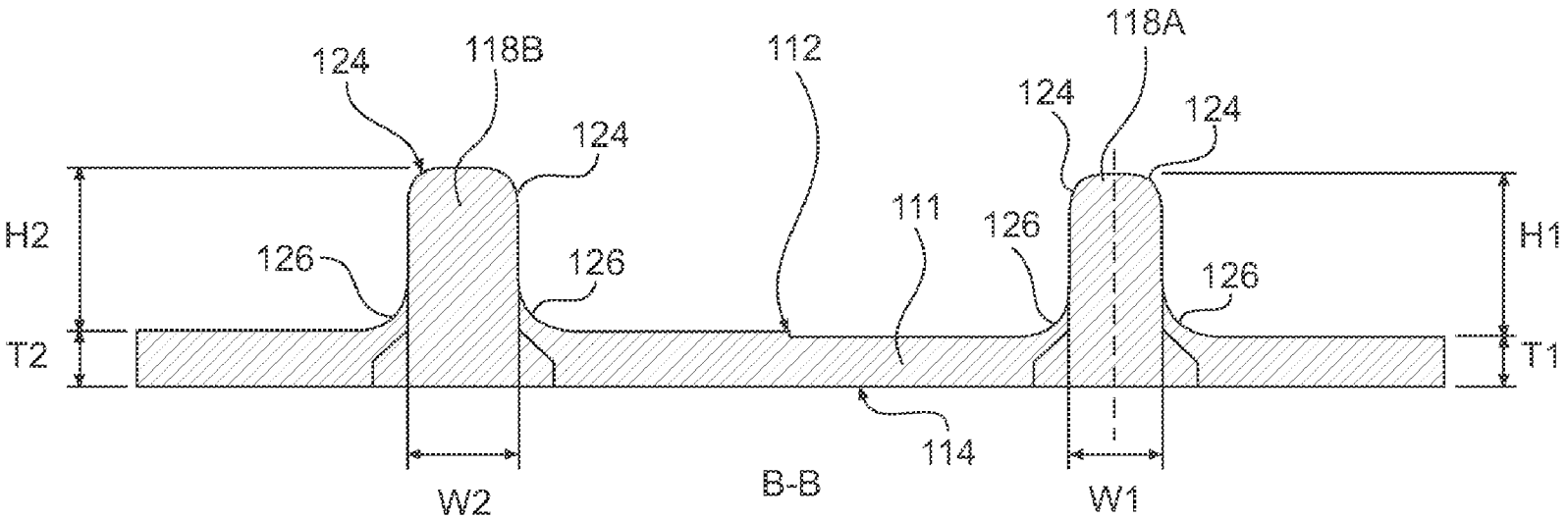
FIG. 9 is a cross-sectional view of two ribs taken along line B-B in FIG. 6.

Turning now to FIG. 9, it can be seen that the port ribs 118 (in this case 118A and 118B) are integrally formed with the hull body 111 by a molding process described in greater detail below. It is contemplated that the ribs 118 could be made separately from the hull body 111 and then affixed, by an adhesive for example, to the inner surface 112. The corners 124 of the ribs 118 are rounded to facilitate the molding process and reduce stress. For the same reason and for reducing the stress between the ribs 118 and the upper surface 112 of the hull body 111, the interface 126 between the ribs 118 and the upper surface 112 of the hull body 111 are also rounded. To facilitate the removal of the hull 12 from the molds, the ribs 118 are also slightly tapered. A width of the ribs 118 may vary along their lengths and may vary from one rib to the other to provide increased or reduced rigidity in different sections of the hull 12. As can be seen, the rib 118A has a width W1 which is less than a width W2 of rib 118B. However, the width of each rib 118 is preferably less than its height. As can be seen a height H1 of rib 118A is greater than its width W1. Similarly, a height H2 of rib 118B is greater than its width W2. It should be understood that the description of port ribs 118 provided above also applies to starboard ribs 120.

Figure 8:
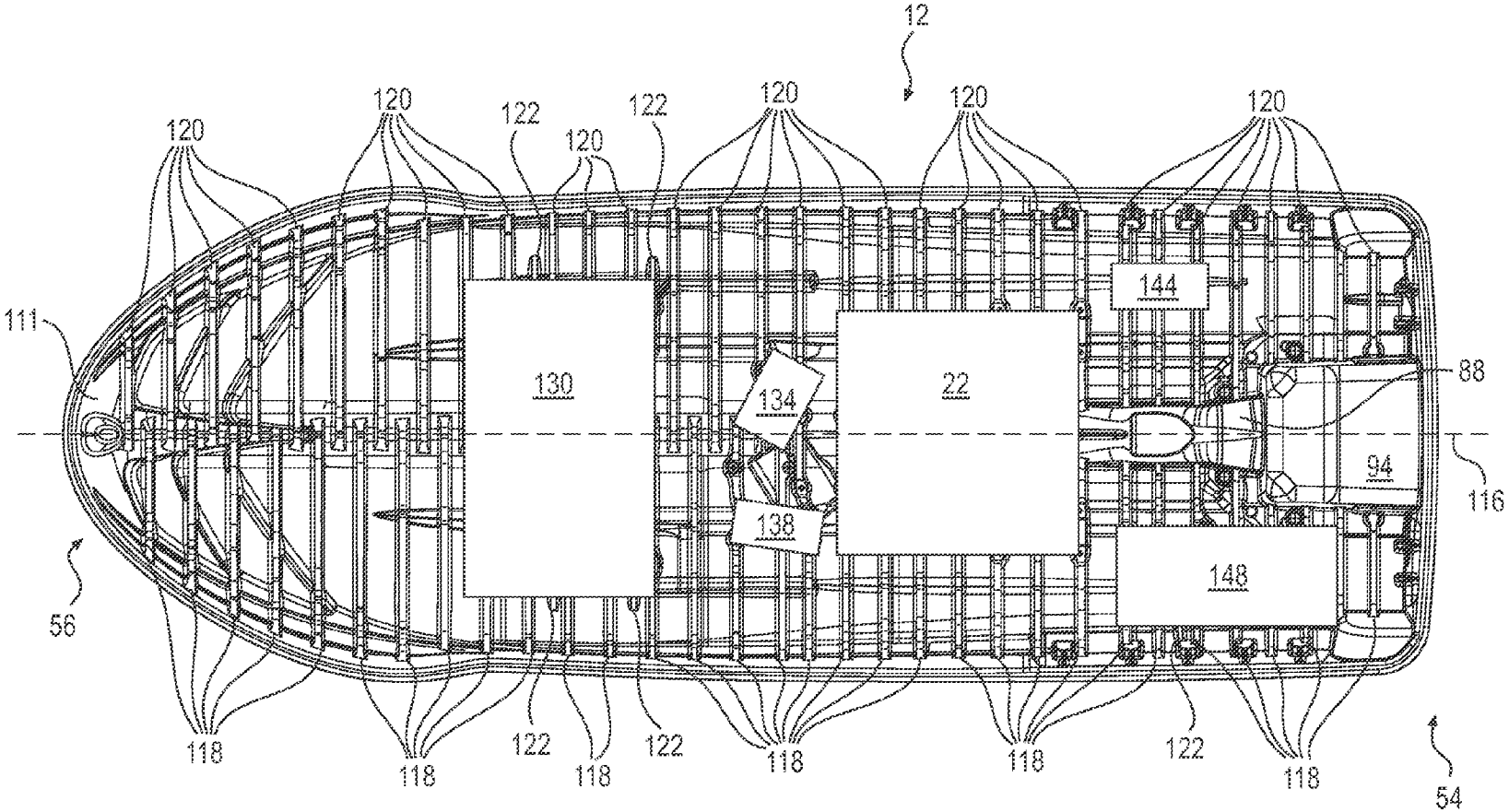
FIG. 8 is a top view of the hull of FIG. 6 with some of the components of the watercraft of FIG. 1 shown schematically in their position in the hull.

Turning back to FIG. 6, it can be seen that some of the ribs 118, 120, and 122 are provided with one or more enlarged portions 128, 132, 136, 140, 142, and 146 used to provide attachment points for some of the components of the watercraft 10. However, it is contemplated that attachment points could be provided without the use of enlarged portions. The enlarged portions 128 provide attachment points for a fuel tank 130 of the watercraft 10 as shown in FIG. 8. More enlarged portions 128 are provided than are necessary to attach a fuel tank 130. This permits the attachment of different sizes of fuel tanks 130 to the same hull 12. The enlarged portions 132 provide attachment points for a battery support 134 as shown in FIG. 8. The battery support 134 holds the battery (not shown) of the watercraft 10. The enlarged portions 136 provide attachment points for an electronic module support 138 as shown in FIG. 8. The electronic module support 138 holds an electronic module (not shown) used to control the engine 22 of the watercraft 10. The enlarged portions 140 provide attachment points for the engine 22 of the watercraft 10 as shown in FIG. 8. More enlarged portions 140 are provided than are necessary to attach the engine 22. This permits the attachment of different types and sizes of engines 22 to the same hull 12. The enlarged portion 142 provides an attachment point for a resonator 144 used in the exhaust system of the watercraft 10 as shown in FIG. 8. The enlarged portions 146 provide attachment points for a muffler 148 used in the exhaust system of the watercraft 10 as shown in FIG. 8. An area of increased thickness in the hull body 111 provides an attachment point 150 for the inlet grate of the inlet 86. An area of increased thickness in the hull body 111 located around the tunnel 94 provides attachment point 152 for the ride plate 96. These areas of increased thickness allow fasteners to be used without going through the hull 12. Bosses or short ribs 154 (labeled only in FIG. 12 for clarity) integrally formed in the side walls 115 provide attachment points for the sponsons 70.

Figure 10:
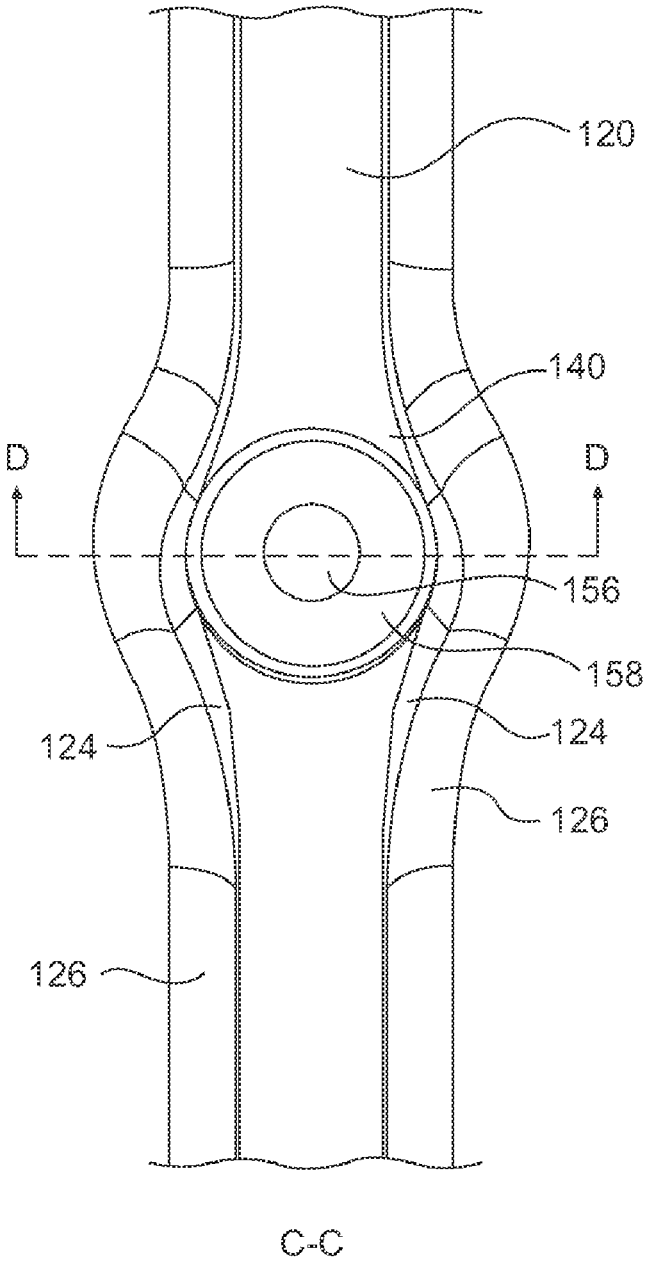
FIG. 10 is a close-up view of section C-C of FIG. 6 showing an enlarged portion of a rib.
Figure 11:
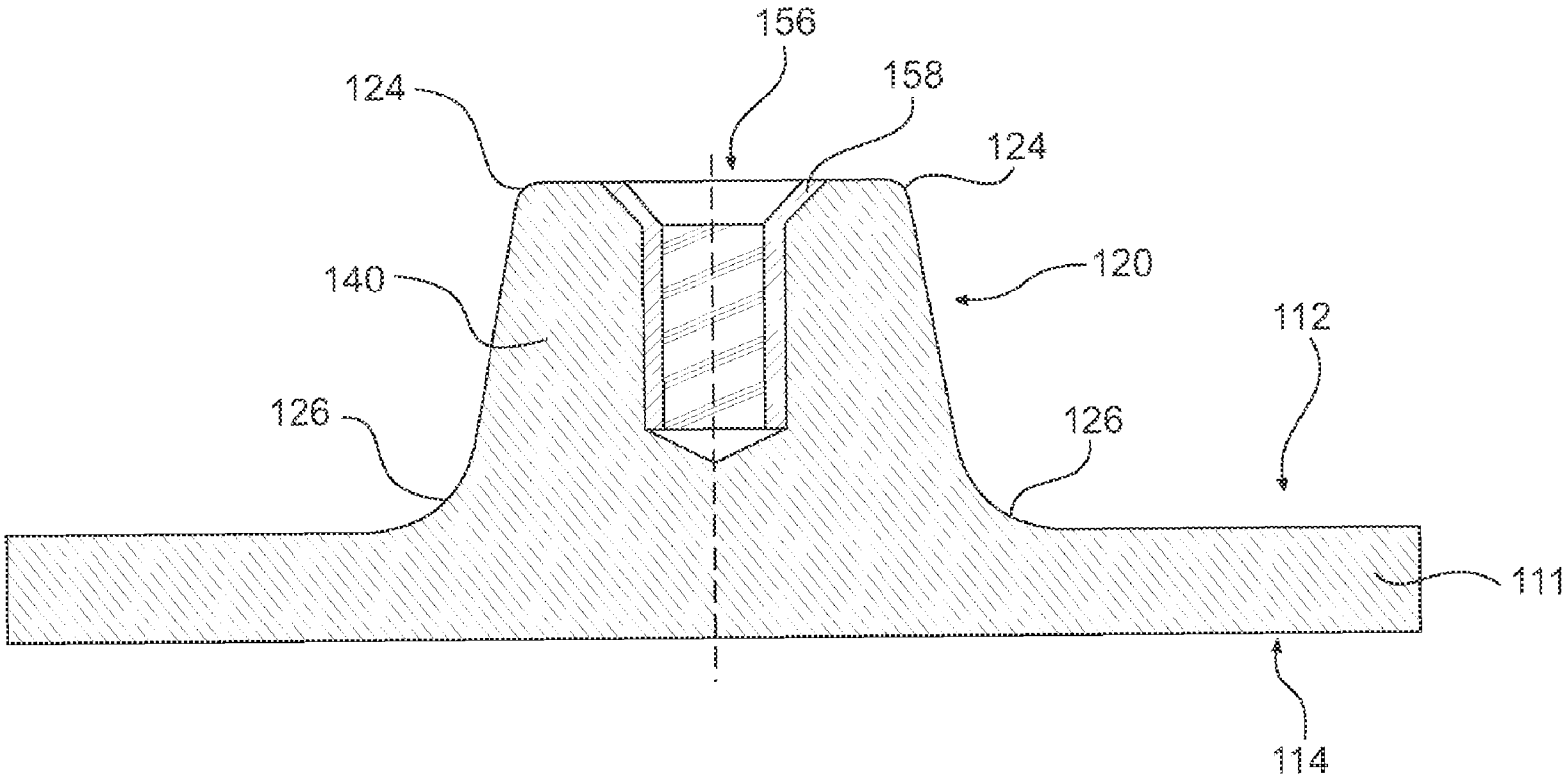
FIG. 11 is a cross-sectional view of the enlarged portion of a rib taken along line D-D of FIG. 10.

Turning now to FIGS. 10 and 11, one of the enlarged portions 140 disposed in a starboard rib 120 will be described in more detail. It should be understood that the other enlarged portions 128, 132, 136, 140, and 142 would have similar configurations, and as such will not be described in detail herein. The enlarged portion 140 is provided with a central aperture 156 having a chamfered upper end. A threaded insert 158 adapted to receive a threaded fastener is disposed inside the aperture 156. It is contemplated that the enlarged portion 140 could have no central aperture 156 or no threaded insert 158. In such cases, self-tapping/self-threading fasteners (as the case may be) would be used. It is also contemplated that apertures could also be provided in the outer surface 114 of the hull body 111 in alignment with other enlarged portions in the ribs 118, 120, 122 to attach components on the outer surface 114 of the hull body 111. For example, bosses 154 could be replaced with enlarged portions in ribs 118, 120 near the transom 54 of the hull 12 to attach the sponsons 70 to the hull 12. Although the ribs 118, 120, and 122 preferably have a height which is greater than their width, it is contemplated, as shown in FIG. 11, that their enlarged portions 128, 132, 136, 140, and 142 may have a width which is equal to or greater than their height in order to provide a strong enough attachment point.

Figure 13:
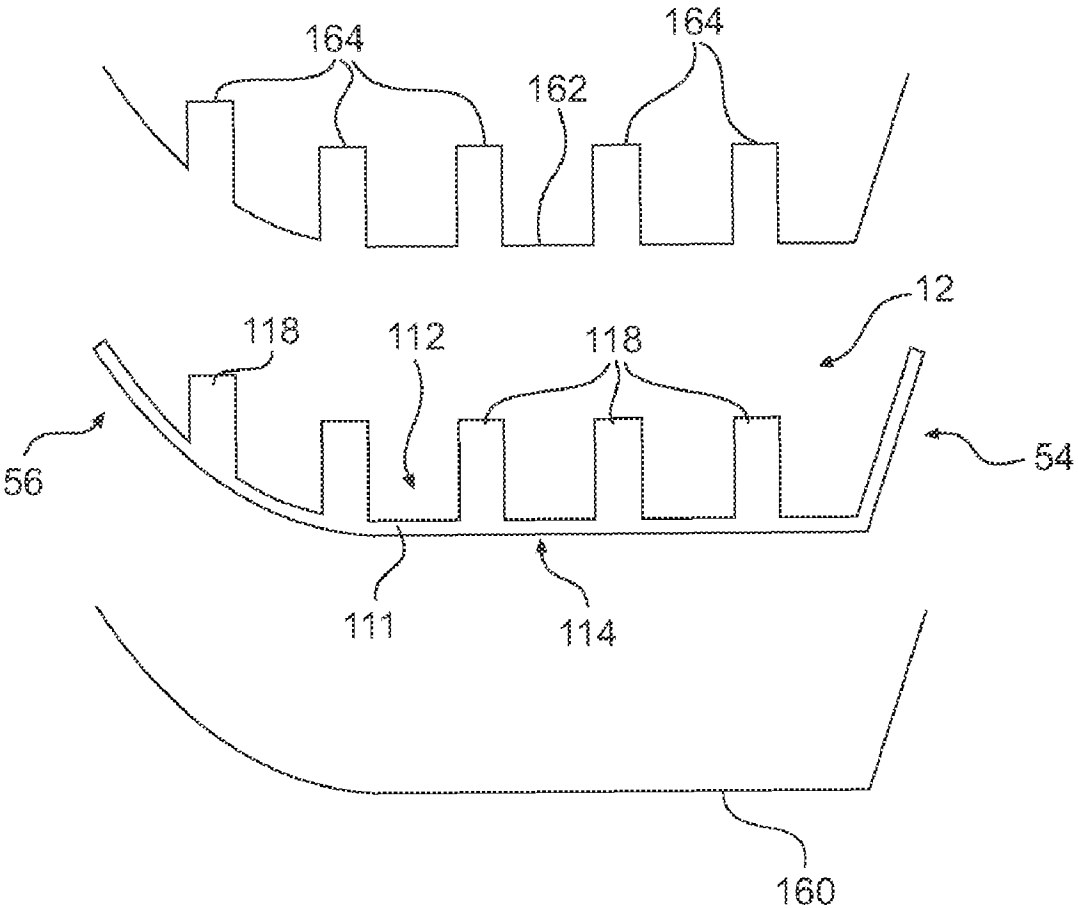
FIG. 13 is a schematic illustration of a longitudinal cross-section of a hull and the molds used in its fabrication.
Figure 1:
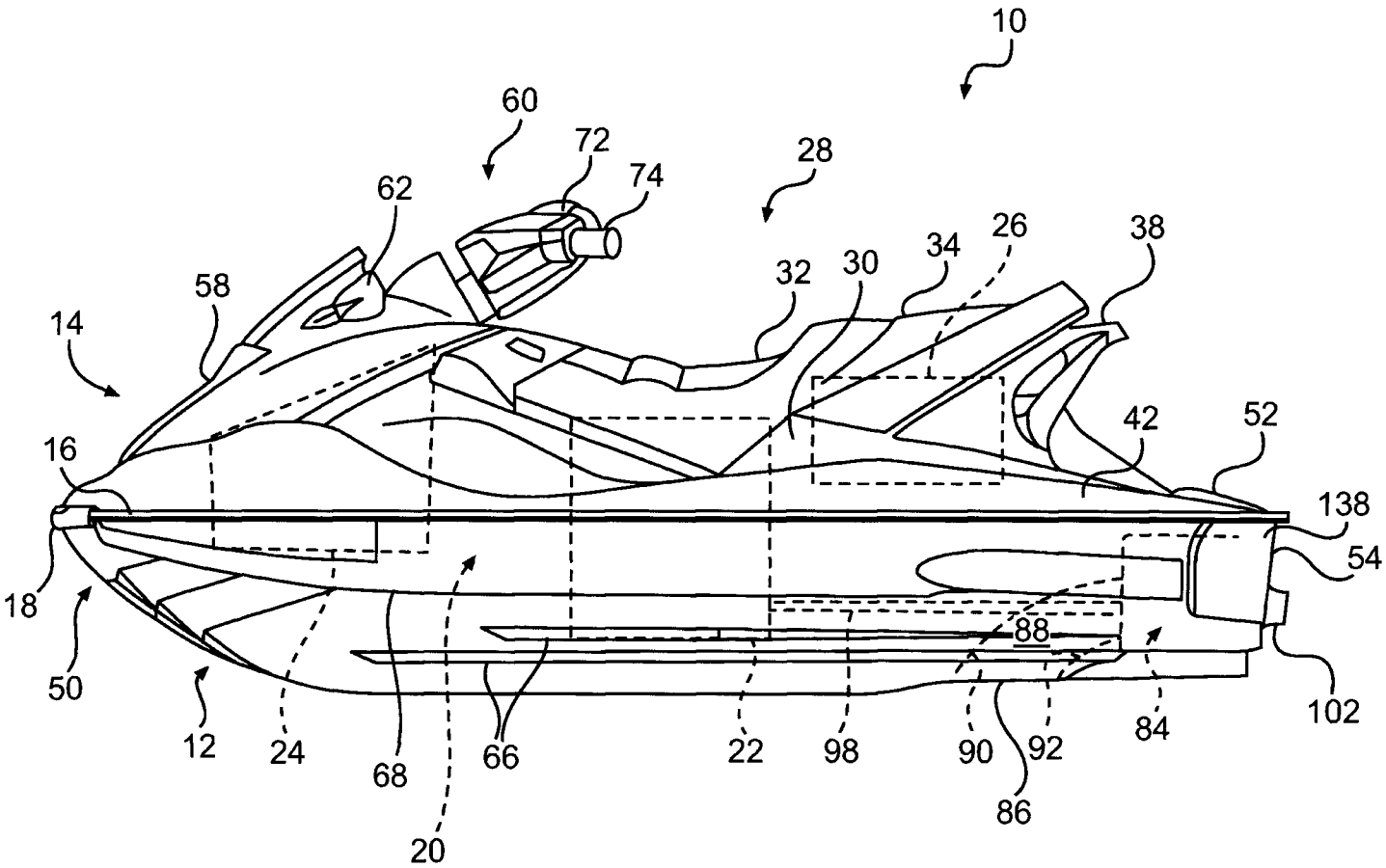
Figure 2:
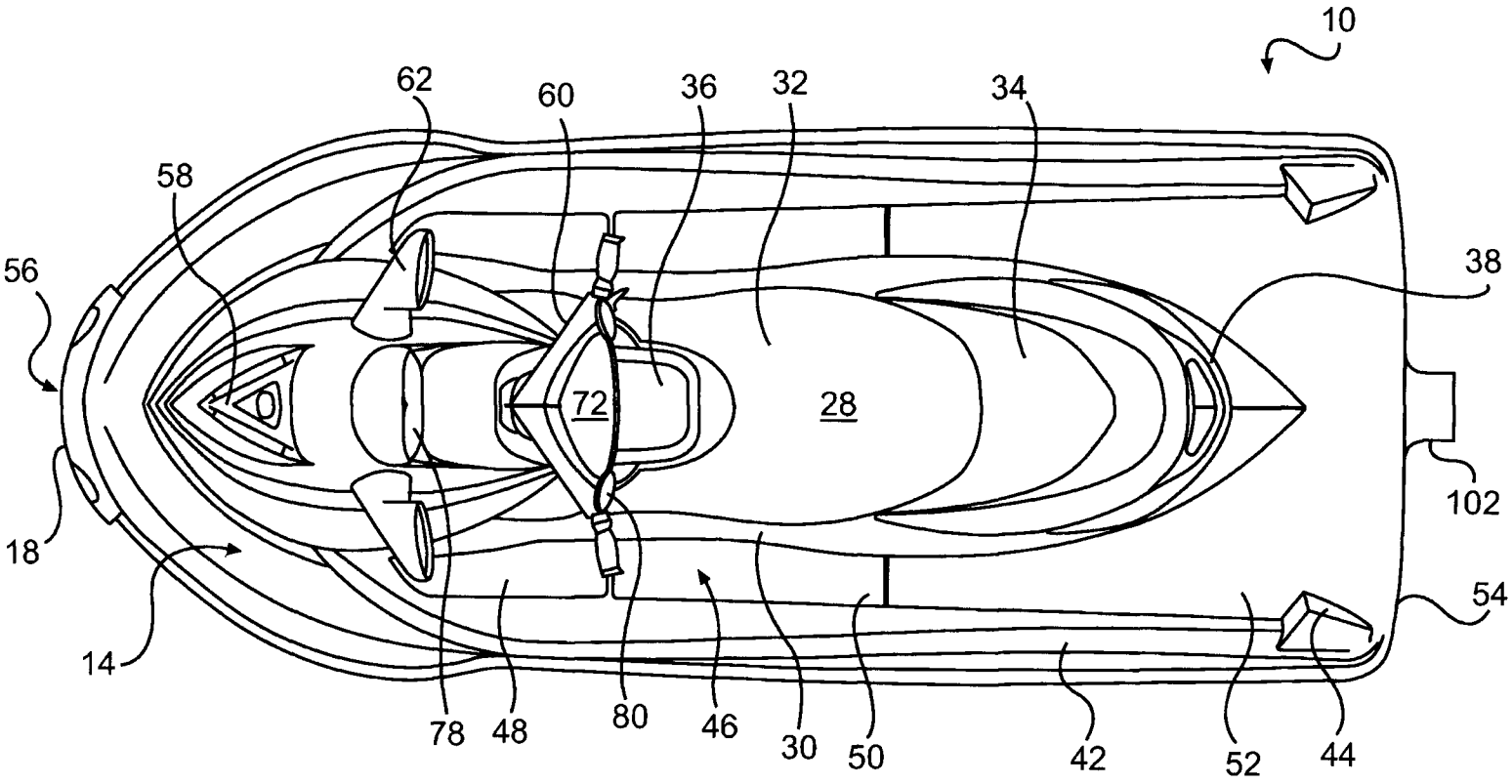
Figure 3:
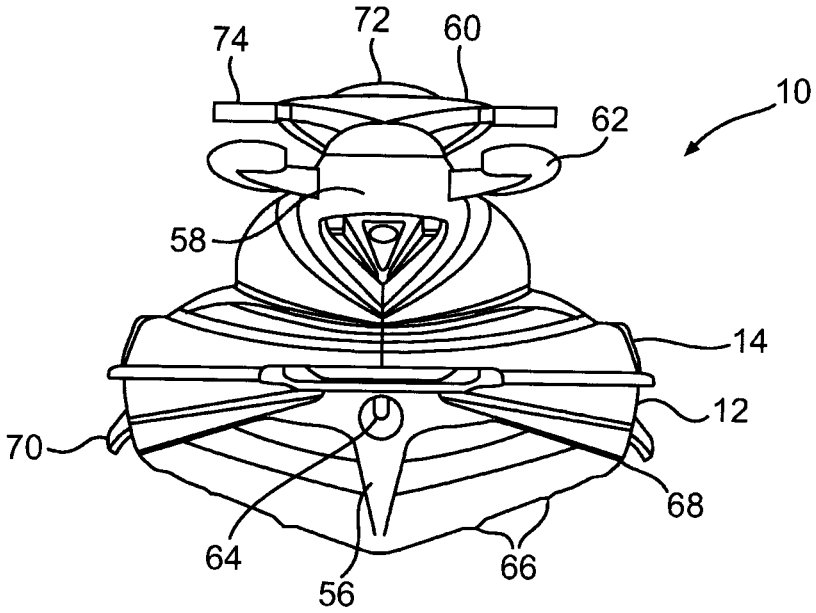
Figure 4:
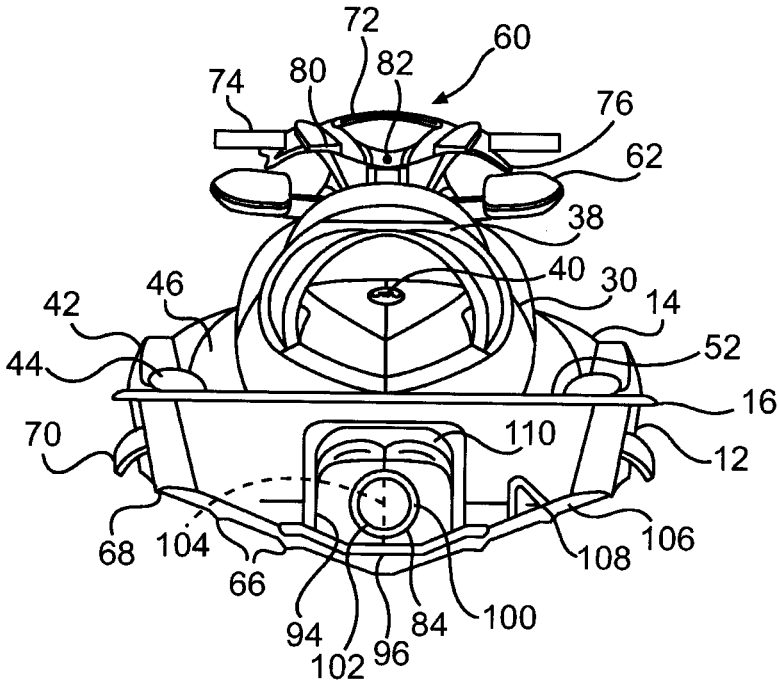
Figure 5:
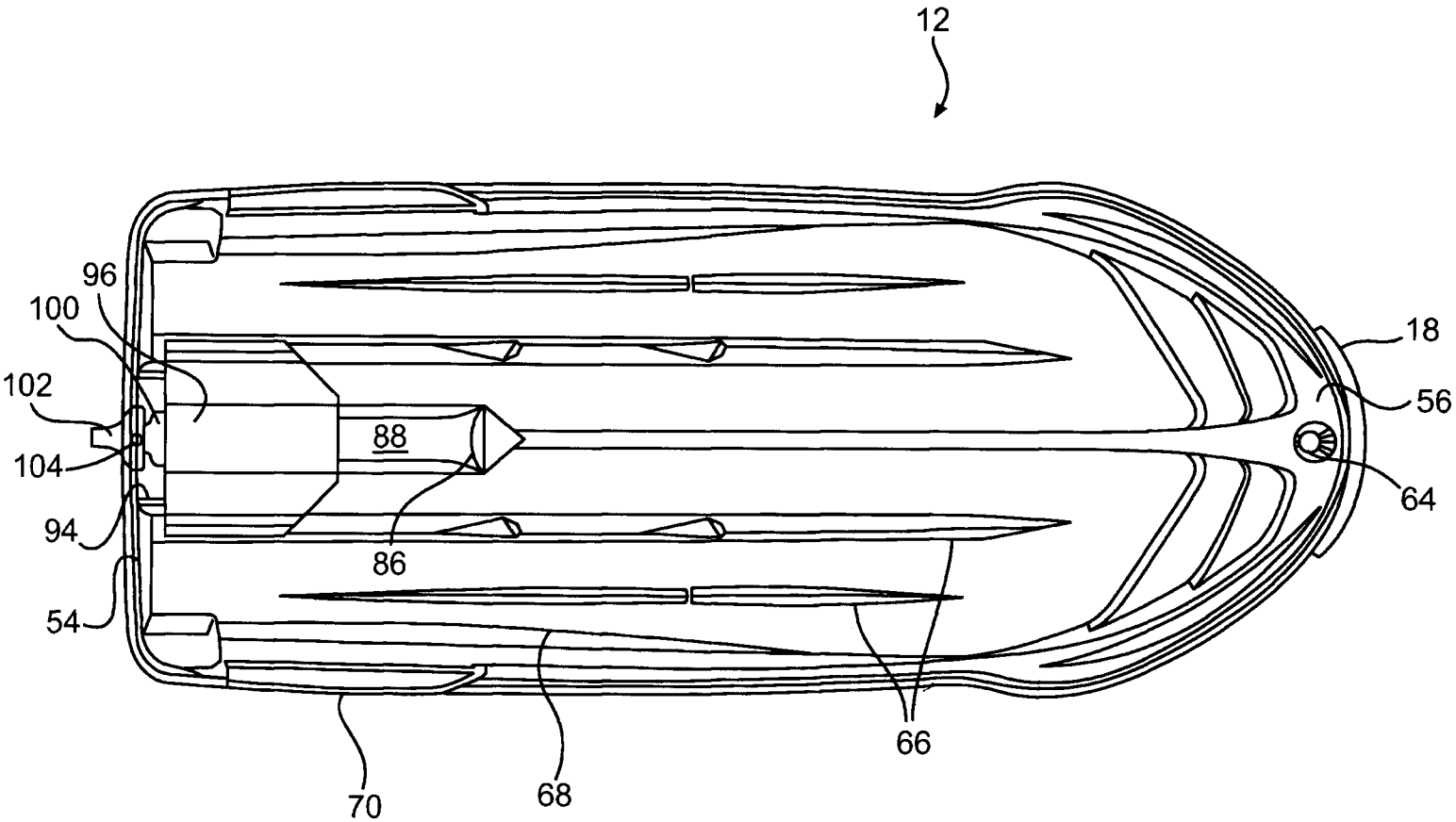
Figure 6:
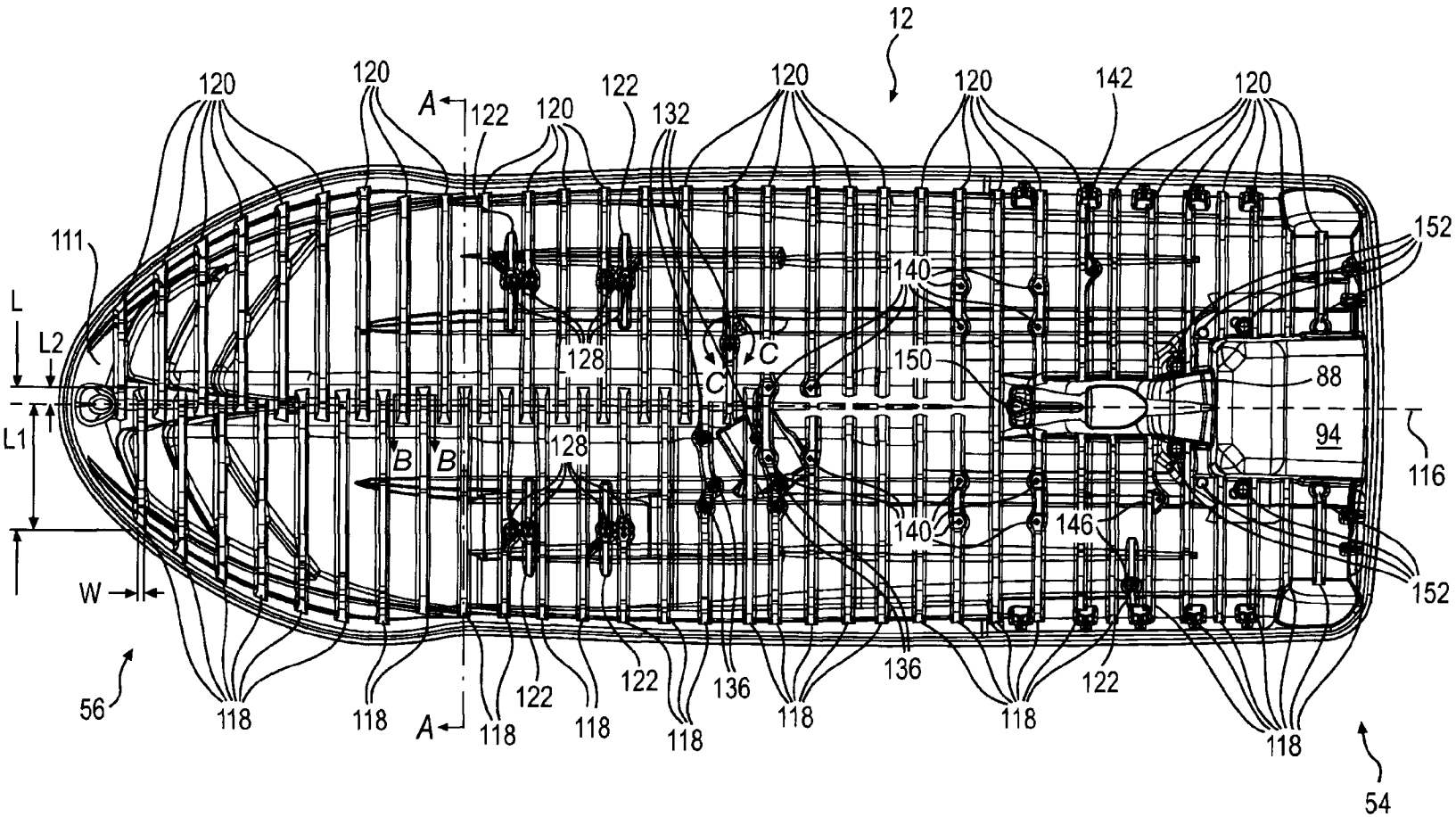
Figure 7:
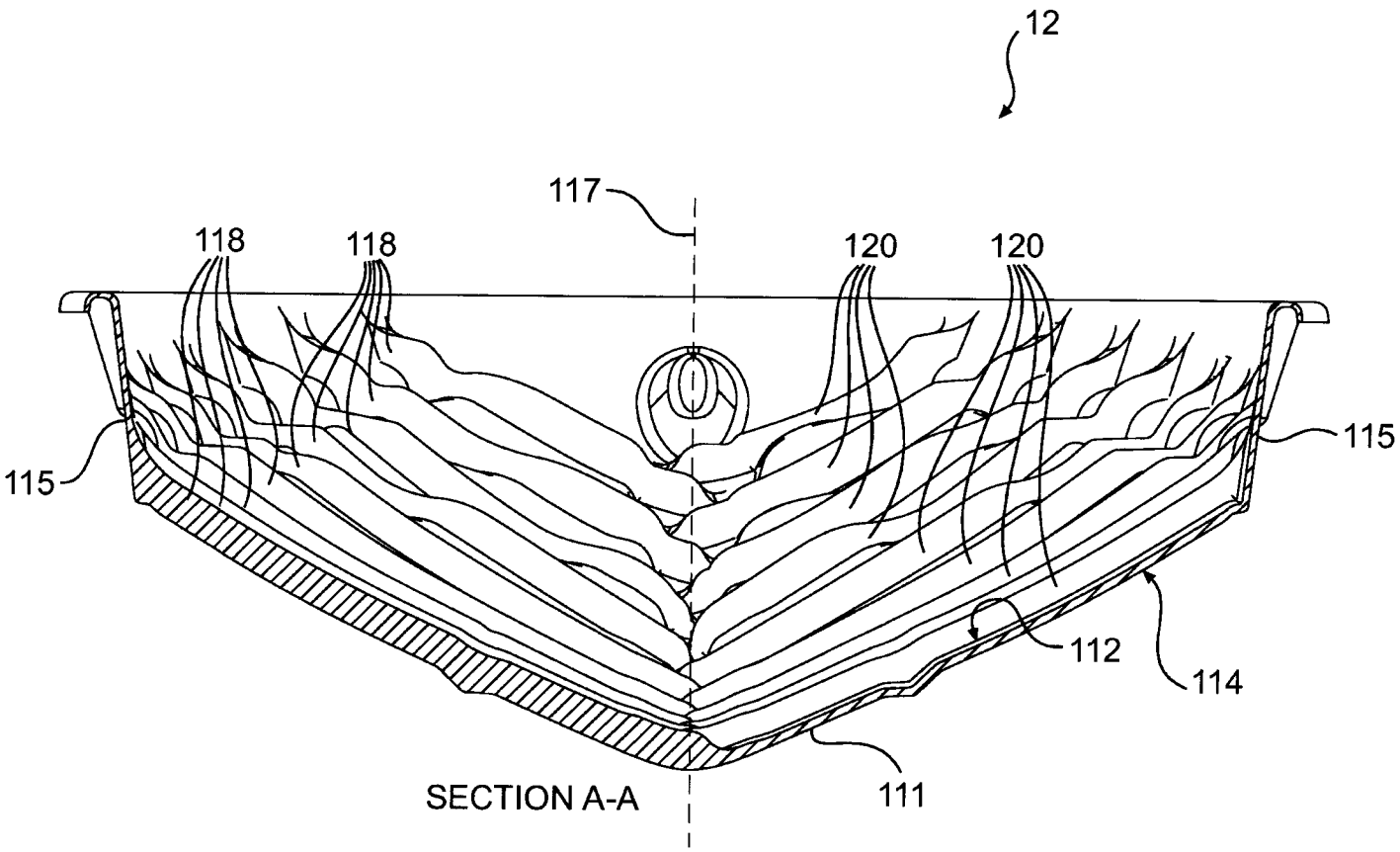
Figure 8:
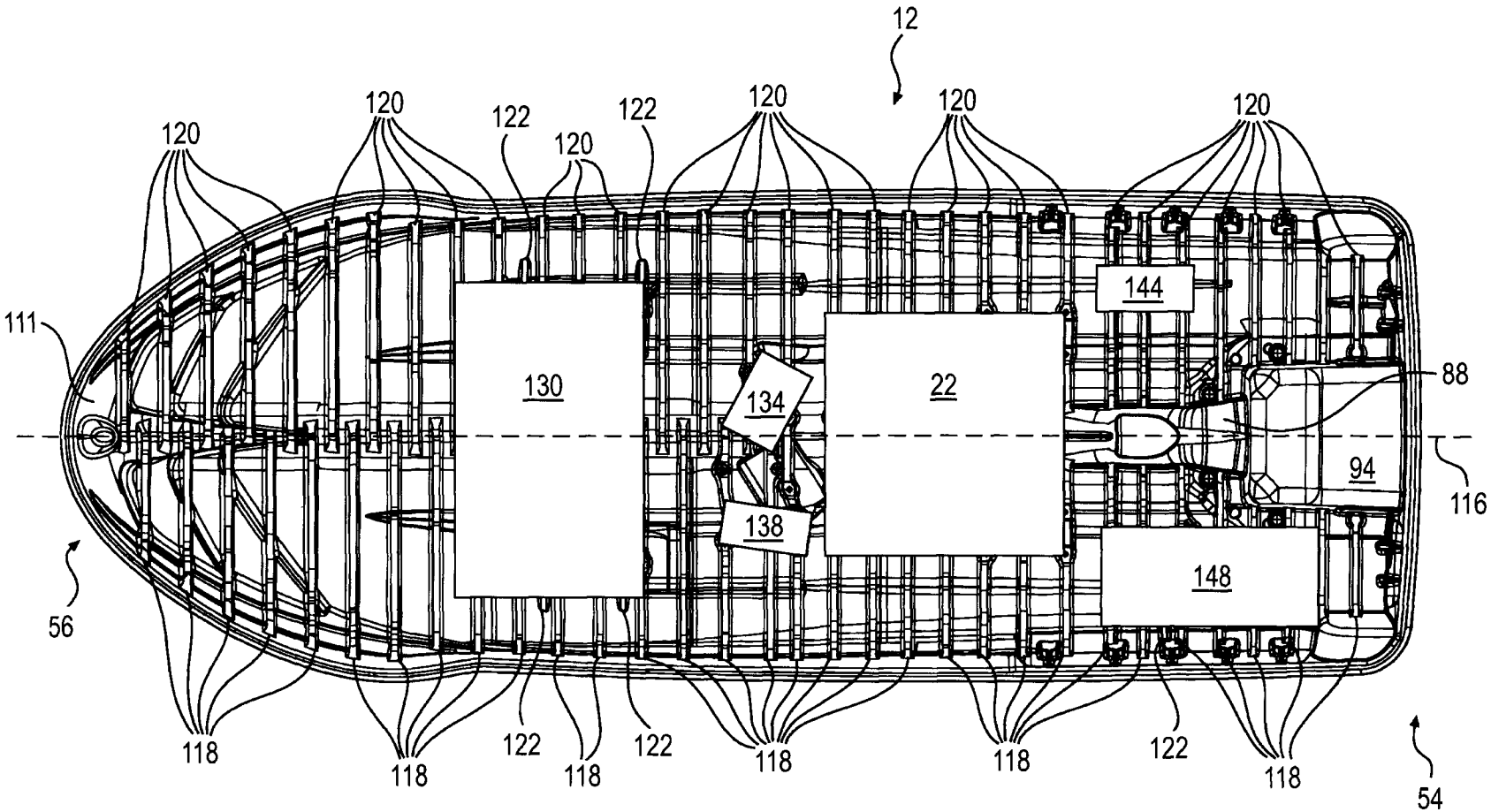
Figure 9:
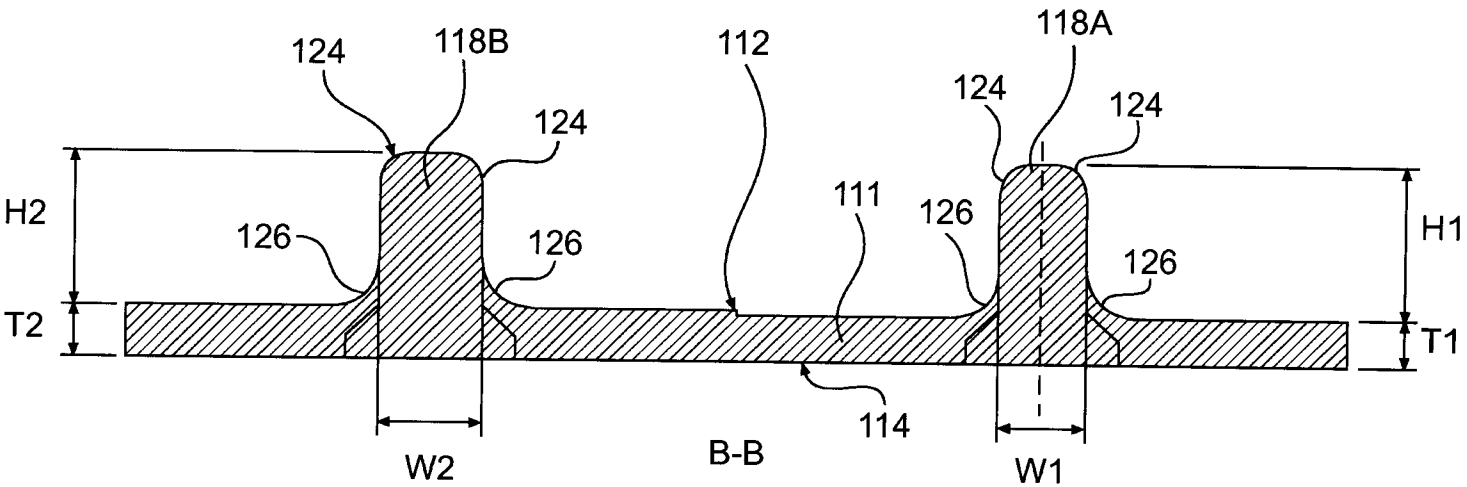
Figure 10:
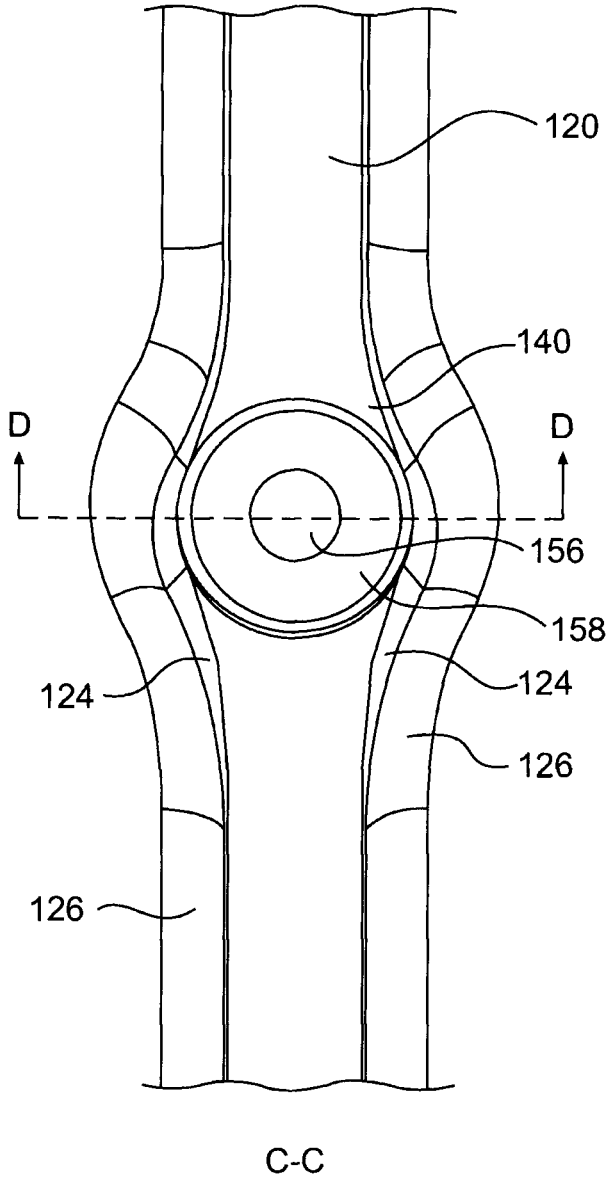
Figure 11:
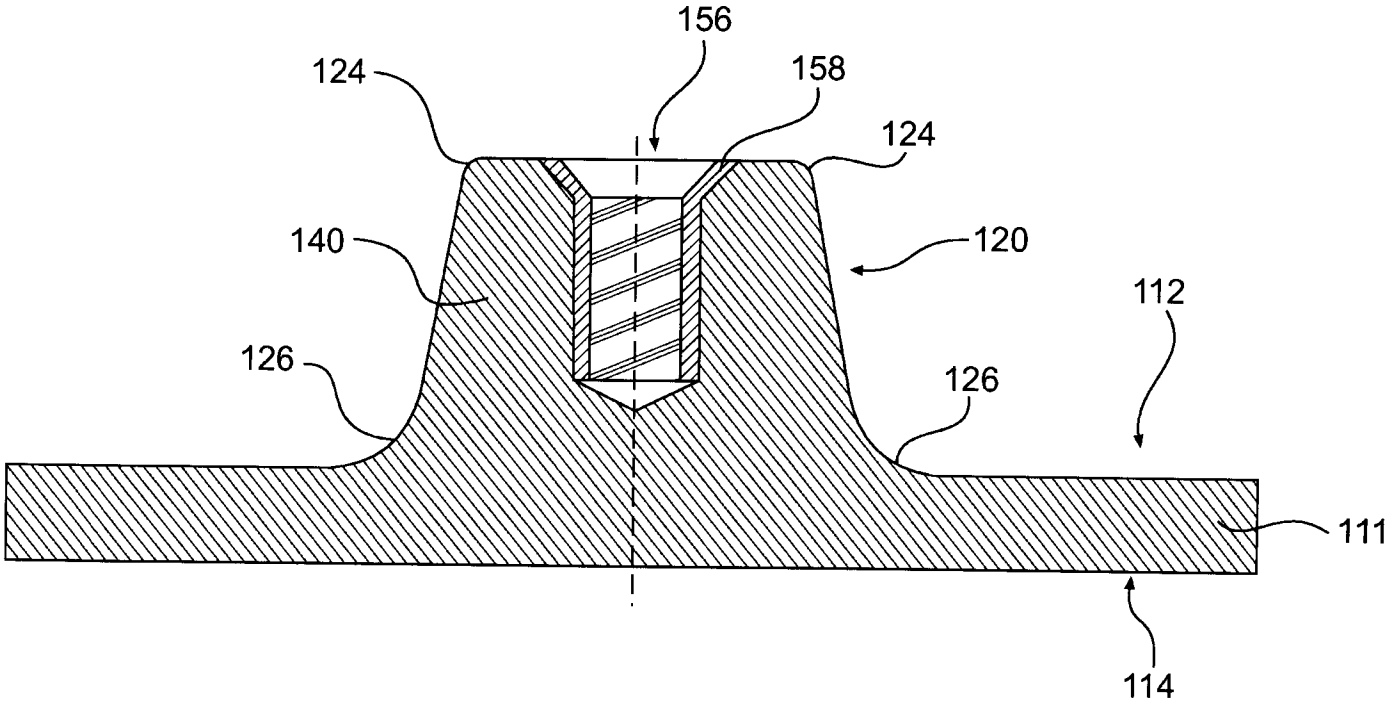
Figure 12:
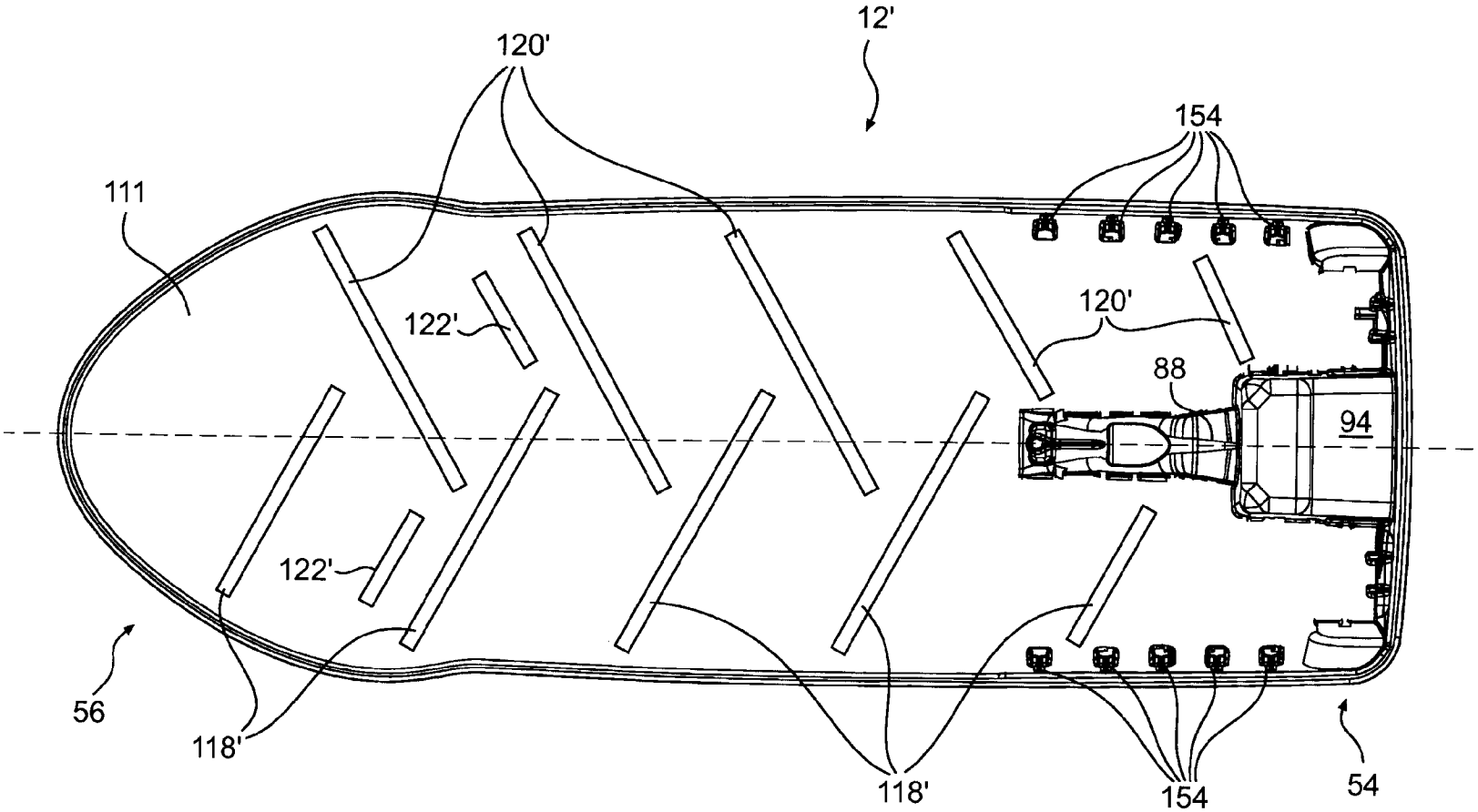
Figure 13:
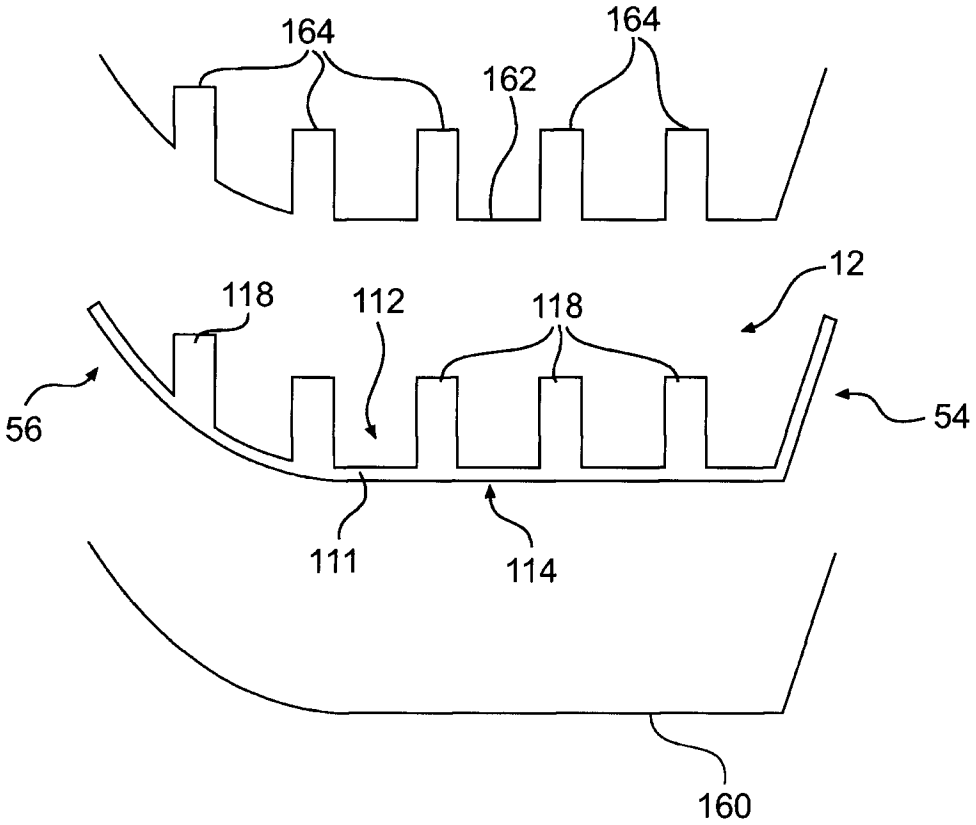

Turning now to FIG. 13, a molding process used to manufacture the hull 12 will be described. For simplicity, FIG. 13 only illustrates a schematic longitudinal cross-section taken on a port side of the components involved in the process. A female mold 160 is first sprayed with a gel coat, or any other type of in-mold coating, and then sprayed with a composite, preferably a mixture of cut glass fibers and urethane resin. The spraying is preferably done by robotic arms. The female mold 160 defines the outside geometry of the hull 12 and the features of the outer surface 114 of the hull body 111 (i.e. strakes 66, chines 68 . . . ). A male mold 162 is then placed inside the female mold 160 so as to compress the composite therebetween. The male mold 162 defines the inner geometry of the hull 12, the features of the inner surface, and the ribs 118, 120, and 122. In order to ensure that the composite will properly flow inside and completely fill the rib defining sections 164 of the male mold 162, the hull 12 has to be preferably designed such that a width of a rib is at least 1.5 times a thickness of the hull body 111 at a position adjacent that rib. For example, as shown in FIG. 9, the width W1 of rib 118A is about twice the thickness T1 of the hull body 111 adjacent rib 118A, and the width W2 of rib 118B is about twice the thickness T2 of the hull body 111 adjacent rib 118B. Once the composite is compressed, it is polymerized, and then the female mold 160 and the male mold 162 are separated and the finished hull 12 removed. It is contemplated that other molding processes could be used.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft hull comprising:

a hull body defining a bow, a transom, and a longitudinal centerline extending from the bow to the transom along a center of the hull body, the hull body having an inner surface and an outer surface;

at least one port rib extending at an angle to the longitudinal centerline on the inner surface, the at least one port rib having a first portion disposed on a port side of the longitudinal centerline and a second portion disposed on a starboard side of the longitudinal centerline, the first portion being longer than the second portion; and at least one starboard rib extending at an angle to the longitudinal centerline on the inner surface, the at least one starboard rib having a first portion disposed on the starboard side of the longitudinal centerline and a second portion disposed on the port side of the longitudinal centerline, the first portion being longer than the second portion, one of the at least one port rib and the at least one starboard rib being disposed at least in part forwardly of the other of the at least one port rib and the at least one starboard rib.

2. The hull of claim 1, wherein the at least one port rib is a plurality of port ribs and the at least one starboard rib is a plurality of starboard ribs; and wherein the plurality of port ribs and the plurality of starboard ribs are disposed in an alternating arrangement along a length of the hull body.

3. The hull of claim 2, further comprising a secondary rib extending at an angle to the longitudinal centerline on the inner surface, the secondary rib being disposed completely on one side of the longitudinal centerline.

4. The hull of claim 2, wherein the plurality of port ribs and the plurality of starboard ribs extend generally perpendicularly to the longitudinal centerline.

5. The hull of claim 2, wherein at least one of the plurality of port ribs and the plurality of starboard ribs has an enlarged portion adapted to receive a fastener.

6. The hull of claim 5, further comprising a threaded insert disposed in the enlarged portion.

7. The hull of claim 1, wherein the hull body defines a port side wall and a starboard side wall;

wherein at least part of the first portion of the at least one port rib extends along the port side wall; and wherein at least part of the first portion of the at least one starboard rib extends along the starboard side wall.

8. The hull of claim 1, wherein the hull body, the at least one port rib, and the at least one starboard rib are integrally formed.

9. The hull of claim 8, wherein the hull body, the at least one port rib, and the at least one starboard rib are made of a mixture of cut glass fibers and urethane resin.

10. The hull of claim 1, wherein a height of at least one port rib is greater than a width of the at least one port rib; and wherein a height of at least one starboard rib is greater than a width of the at least one starboard rib.

11. The hull of claim 1, wherein a width of the at least one port rib is at least 1.5 times a thickness of the hull body at a position adjacent the at least one port rib; and wherein a width of the at least one starboard rib is at least 1.5 times a thickness of the hull body at a position adjacent the at least one starboard rib.

12. A watercraft hull comprising:

a hull body defining a bow, a transom, and a longitudinal centerline extending from the bow to the transom along a center of the hull body, the hull body having an inner surface and an outer surface;

at least one first rib extending at an angle to the longitudinal centerline on the inner surface, the at least one first rib being disposed completely on one of a port side and a starboard side of the longitudinal centerline; and at least one second rib extending at an angle to the longitudinal centerline on the inner surface, the at least one second rib having a first portion disposed on the other of the port side and the starboard side of the longitudinal centerline and a second portion disposed on the one of the port side and the starboard side of the longitudinal centerline, the first portion being longer than the second portion.

13. The hull of claim 12, wherein the at least one first rib is a plurality of first ribs and the at least one second rib is a plurality of second ribs.

14. The hull of claim 12, wherein at least one of the at least one first rib and the at least one second rib has an enlarged portion adapted to receive a fastener.

15. The hull of claim 14, further comprising a threaded insert disposed in the enlarged portion.

16. The hull of claim 12, wherein a height of at least one first rib is greater than a width of the at least one first rib; and wherein a height of at least one second rib is greater than a width of the at least one second rib.

17. The hull of claim 12, wherein a width of the at least one first rib is at least 1.5 times a thickness of the hull body at a position adjacent the at least one first rib; and wherein a width of the at least one second rib is at least 1.5 times a thickness of the hull body at a position adjacent the at least one second rib.

18. The hull of claim 12, wherein the at least one first rib and the at least one second rib extend generally perpendicularly to the longitudinal centerline.

19. The hull of claim 12, further comprising:

at least one third rib extending at an angle to the longitudinal centerline on the inner surface, the at least one third rib being disposed completely on the other of the port side and the starboard side of the longitudinal centerline; and at least one fourth rib extending at an angle to the longitudinal centerline on the inner surface, the at least one fourth rib having a first portion disposed on the one of the port side and the starboard side of the longitudinal centerline and a second portion disposed on the other of the port side and the starboard side of the longitudinal centerline, the first portion being longer than the second portion.

* * * * *

UNITED STATES PATENT AND TRADEMARK OFFICE

CERTIFICATE OF CORRECTION

PATENT NO. : 7,958,838 B1
APPLICATION NO. : 11/962977
DATED : June 14, 2011
INVENTOR(S) : Benoit Larose et al.

It is certified that error appears in the above-identified patent and that said Letters Patent is hereby corrected as shown below:

The title page showing the illustrative figure should be deleted to be replaced with the attached title page.

In the drawings, Figs. 1-13 should be replaced with the corrected Figs. 1-13 as shown on the attached pages.

Signed and Sealed this
Tenth Day of April, 2012

David J. Kappos

David J. Kappos
*Director of the United States Patent and Trademark Office*

(12) United States Patent
Larose et al.

(10) Patent No.: US 7,958,838 B1
(45) Date of Patent: Jun. 14, 2011

(54) WATERCRAFT HULL

(75) Inventors: Benoit Larose, Mont-Saint-Hilaire (CA); Michel Bourret, Drummondville (CA)

(73) Assignee: Bombardier Recreational Products Inc., Valcourt (CA)

( * ) Notice: Subject to any disclaimer, the term of this patent is extended or adjusted under 35 U.S.C. 154(b) by 720 days.

(21) Appl. No.: 11/962,977

(22) Filed: Dec. 21, 2007

(51) Int. Cl.
*B63B 5/00* (2006.01)
*B63B 5/24* (2006.01)

(52) U.S. Cl. ..... 114/355; 114/357

(58) Field of Classification Search ..... 114/65 R, 114/355–359, 55.5–55.58
See application file for complete search history.

(56) References Cited

U.S. PATENT DOCUMENTS

| | | | | | |
|---|---|---|---|---|---|
| 2,400,771 | A | * | 5/1946 | Moxham, Jr. | 114/65 R |
| 2,422,183 | A | * | 6/1947 | Clement, Jr. | 114/358 |
| 2,683,269 | A | * | 7/1954 | Harkins | 114/125 |
| 2,956,292 | A | * | 10/1960 | Newsome | 114/357 |
| 3,593,354 | A | | 7/1971 | Carter | |
| 3,736,608 | A | * | 6/1973 | Whitehead | 114/356 |
| 3,848,284 | A | | 11/1974 | Livingston | |
| 4,041,561 | A | | 8/1977 | Humphrey | |
| 4,044,414 | A | | 8/1977 | Grycel | |
| 4,214,332 | A | | 7/1980 | Stoner | |
| 4,405,669 | A | * | 9/1983 | Pott | 428/61 |
| 4,917,037 | A | | 4/1990 | Hargett | |
| 5,036,789 | A | * | 8/1991 | Kelly et al. | 114/357 |
| 5,758,594 | A | | 6/1998 | Siewert | |
| 5,787,836 | A | | 8/1998 | Blaisdell et al. | |
| 5,799,604 | A | * | 9/1998 | Long | 114/359 |
| 6,161,496 | A | | 12/2000 | Folks | |
| 6,182,591 | B1 | | 2/2001 | Whitesides et al. | |
| 6,471,557 | B1 | | 10/2002 | Hattori | |
| 2004/0261937 | A1 | * | 12/2004 | Pellicer | 156/242 |
| 2005/0056200 | A1 | * | 3/2005 | Pigeon | 114/357 |

FOREIGN PATENT DOCUMENTS

JP 06199274 A * 7/1994

* cited by examiner

*Primary Examiner* Ajay Vasudeva
(74) *Attorney, Agent, or Firm* — Olser, Hoskin & Harcourt LLP

(57) ABSTRACT

A watercraft hull has a hull body defining a bow, a transom, and a longitudinal centerline extending from the bow to the transom along a center of the hull body. The hull body has an inner surface and an outer surface. A plurality of ribs extends at an angle to the longitudinal centerline on the inner surface.

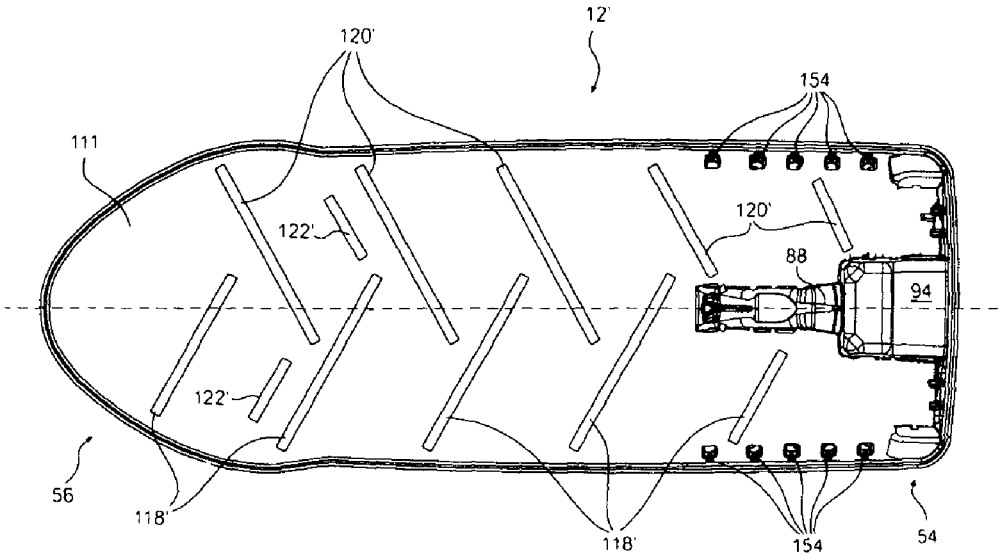

19 Claims, 12 Drawing Sheets